US010768560B2

(12) United States Patent
Takagi et al.

(10) Patent No.: US 10,768,560 B2
(45) Date of Patent: Sep. 8, 2020

(54) IMAGE FORMING APPARATUS AND IMAGE FORMING METHOD

(71) Applicant: CANON KABUSHIKI KAISHA, Tokyo (JP)

(72) Inventors: Kenji Takagi, Odawara (JP); Daizo Fukuzawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/727,067

(22) Filed: Dec. 26, 2019

(65) Prior Publication Data

US 2020/0209789 A1 Jul. 2, 2020

(30) Foreign Application Priority Data

Dec. 26, 2018 (JP) ..... 2018-242510

(51) Int. Cl.
*G03G 15/20* (2006.01)

(52) U.S. Cl.
CPC ..... *G03G 15/2039* (2013.01)

(58) Field of Classification Search
CPC ..... G03G 15/00; G03G 15/01; G03G 15/20; G03G 15/2039; G03G 15/5025; G03G 15/5045; G03G 15/5087
USPC ..... 399/38, 67, 69, 320, 328
See application file for complete search history.

(56) References Cited

U.S. PATENT DOCUMENTS

| | | | | |
|---|---|---|---|---|
| 8,301,050 | B2 * | 10/2012 | Funatsu | G03G 15/5062 399/67 |
| 9,069,311 | B2 * | 6/2015 | Ohba | G03G 15/2039 |
| 10,054,882 | B2 * | 8/2018 | Nomura | G03G 15/2039 |

FOREIGN PATENT DOCUMENTS

| | | | |
|---|---|---|---|
| JP | 2004271910 | A | 9/2004 |
| JP | 2014056036 | A | 3/2014 |
| JP | 2015055747 | A | 3/2015 |
| JP | 2016004231 | A | 1/2016 |

* cited by examiner

*Primary Examiner* — Hoan H Tran
(74) *Attorney, Agent, or Firm* — Venable LLP

(57) ABSTRACT

An image forming apparatus, including: a determining portion to acquire a density value for respective colors of toners, obtain a sum value of the density values of the colors of the toners, obtain a numerical value indicating the number of the density values being values larger than 0 out of the density values corresponding to the colors of the toners, and determine a target temperature on the basis of the sum value and the numerical value, wherein in a case the sum value is a first value and the numerical value is a first number, the determining portion determines a first temperature as the target temperature, in a case the sum value is the first value and the numerical value is a second number that is larger than the first number, the determining portion determines a second temperature that is lower than the first temperature as the target temperature.

16 Claims, 24 Drawing Sheets

GRADATION DATA: 0
IMAGE DENSITY VALUE: 0%

GRADATION DATA: 63
IMAGE DENSITY VALUE: 25%

GRADATION DATA: 127
IMAGE DENSITY VALUE: 50%

GRADATION DATA: 191
IMAGE DENSITY VALUE: 75%

GRADATION DATA: 255
IMAGE DENSITY VALUE: 100%

FIG.8

| | MAXIMUM SUM IMAGE DENSITY VALUE DSUM_MAX | IMAGE DENSITY VALUE OF EACH COLOR | | | | SUM TONER BEARING AMOUNT | TONER COEFFICIENT E | SET TEMPERATURE T | SET TEMPERATURE T0 |
|---|---|---|---|---|---|---|---|---|---|
| | | DY | DM | DC | DK | | | | |
| | 50% | 50% | 0% | 0% | 0% | 0.12 mg/cm$^2$ | 1 | 220°C | 221°C |
| | 50% | 25% | 25% | 0% | 0% | 0.06 mg/cm$^2$ | 2 | 214°C | 221°C |
| | 100% | 100% | 0% | 0% | 0% | 0.45 mg/cm$^2$ | 1 | 240°C | 227°C |
| | 100% | 50% | 50% | 0% | 0% | 0.23 mg/cm$^2$ | 2 | 228°C | 227°C |
| | 100% | 34% | 33% | 33% | 0% | 0.16 mg/cm$^2$ | 3 | 223°C | 227°C |
| | 100% | 25% | 25% | 25% | 25% | 0.13 mg/cm$^2$ | 4 | 220°C | 227°C |
| | 150% | 100% | 50% | 0% | 0% | 0.57 mg/cm$^2$ | 2 | 242°C | 233°C |
| | 150% | 50% | 50% | 50% | 0% | 0.35 mg/cm$^2$ | 3 | 235°C | 233°C |
| | 150% | 37% | 38% | 37% | 38% | 0.27 mg/cm$^2$ | 4 | 230°C | 233°C |
| (A-1) | 200% | 100% | 100% | 0% | 0% | 0.90 mg/cm$^2$ | 2 | 257°C | 240°C |
| (A-2) | 200% | 66% | 67% | 67% | 0% | 0.61 mg/cm$^2$ | 3 | 246°C | 240°C |
| (A-3) | 200% | 50% | 50% | 50% | 50% | 0.47 mg/cm$^2$ | 4 | 240°C | 240°C |
| | 250% | 100% | 100% | 50% | 0% | 1.02 mg/cm$^2$ | 3 | 258°C | 246°C |
| | 250% | 63% | 63% | 62% | 62% | 0.72 mg/cm$^2$ | 4 | 250°C | 246°C |
| | 250% | 75% | 75% | 75% | 25% | 0.80 mg/cm$^2$ | 4 | 250°C | 246°C |
| | 300% | 100% | 100% | 100% | 0% | 1.35 mg/cm$^2$ | 3 | 269°C | 252°C |
| | 300% | 75% | 75% | 75% | 75% | 1.03 mg/cm$^2$ | 4 | 260°C | 252°C |
| | 300% | 100% | 100% | 50% | 50% | 1.13 mg/cm$^2$ | 4 | 260°C | 252°C |

A

FIG.11A

| | | MAXIMUM SUM IMAGE DENSITY VALUE DSUM_MAX | IMAGE DENSITY VALUE OF EACH COLOR | | | | SUM TONER BEARING AMOUNT |
|---|---|---|---|---|---|---|---|
| | | | DY | DM | DC | DK | |
| FIRST EMBODIMENT | CONDITION A | 200% | 100% | 100% | 0% | 0% | 0.90mg/cm$^2$ |
| | CONDITION B | 200% | 66% | 67% | 67% | 0% | 0.61mg/cm$^2$ |
| | CONDITION C | 200% | 50% | 50% | 50% | 50% | 0.47mg/cm$^2$ |
| | | SET TEMPERATURE T | FILM SURFACE TEMPERATURE | | POWER CONSUMPTION | | FIXABILITY |
| FIRST EMBODIMENT | CONDITION A | 256°C | 170°C | | 680W | | GOOD |
| | CONDITION B | 246°C | 160°C | | 660W | | GOOD |
| | CONDITION C | 240°C | 155°C | | 640W | | GOOD |

FIG.11B

| | | MAXIMUM SUM IMAGE DENSITY VALUE DSUM_MAX | IMAGE DENSITY VALUE OF EACH COLOR | | | | SUM TONER BEARING AMOUNT |
|---|---|---|---|---|---|---|---|
| | | | DY | DM | DC | DK | |
| FIRST COMPARATIVE EXAMPLE | CONDITION A | 200% | 100% | 100% | 0% | 0% | 0.90mg/cm$^2$ |
| | CONDITION B | 200% | 66% | 67% | 67% | 0% | 0.61mg/cm$^2$ |
| | CONDITION C | 200% | 50% | 50% | 50% | 50% | 0.47mg/cm$^2$ |
| | | SET TEMPERATURE T0 | FILM SURFACE TEMPERATURE | | POWER CONSUMPTION | | FIXABILITY |
| FIRST COMPARATIVE EXAMPLE | CONDITION A | 256°C | 170°C | | 680W | | GOOD |
| | CONDITION B | 256°C | 170°C | | 679W | | GOOD |
| | CONDITION C | 256°C | 170°C | | 678W | | GOOD |

FIG.11C

| | | MAXIMUM SUM IMAGE DENSITY VALUE DSUM_MAX | IMAGE DENSITY VALUE OF EACH COLOR | | | | SUM TONER BEARING AMOUNT |
|---|---|---|---|---|---|---|---|
| | | | DY | DM | DC | DK | |
| SECOND COMPARATIVE EXAMPLE | CONDITION A | 200% | 100% | 100% | 0% | 0% | 0.90mg/cm$^2$ |
| | CONDITION B | 200% | 66% | 67% | 67% | 0% | 0.61mg/cm$^2$ |
| | CONDITION C | 200% | 50% | 50% | 50% | 50% | 0.47mg/cm$^2$ |
| | | SET TEMPERATURE T0 | FILM SURFACE TEMPERATURE | | POWER CONSUMPTION | | FIXABILITY |
| SECOND COMPARATIVE EXAMPLE | CONDITION A | 240°C | 155°C | | 642W | | NO GOOD |
| | CONDITION B | 240°C | 155°C | | 641W | | NO GOOD |
| | CONDITION C | 240°C | 155°C | | 640W | | GOOD |

*Fig.12A*

| MAXIMUM SUM IMAGE DENSITY VALUE DSUM_MAX | REFERENCE TEMPERATURE T1 |
|---|---|
| 0%≤DSUM_MAX<50% | 213°C |
| 50%≤DSUM_MAX<100% | 222°C |
| 100%≤DSUM_MAX<150% | 231°C |
| 150%≤DSUM_MAX<200% | 240°C |
| 200%≤DSUM_MAX<250% | 249°C |
| 250%≤DSUM_MAX<300% | 258°C |
| 300%≤DSUM_MAX | 267°C |

*Fig.12B*

| TONER COEFFICIENT E | ADJUSTED TEMPERATURE T2 |
|---|---|
| 1 | 0°C |
| 2 | 3°C |
| 3 | 6°C |
| 4 | 9°C |

FIG.13

| MAXIMUM SUM IMAGE DENSITY VALUE DSUM_MAX | IMAGE DENSITY VALUE OF EACH COLOR | | | | SUM TONER BEARING AMOUNT | TONER COEFFICIENT E | REFERENCE TEMPERATURE T1 | ADJUSTED TEMPERATURE T2 | SET TEMPERATURE T=T1-T2 |
|---|---|---|---|---|---|---|---|---|---|
| | DY | DM | DC | DK | | | | | |
| 50% | 50% | 0% | 0% | 0% | 0.12 mg/cm$^2$ | 1 | 222°C | 0°C | 222°C |
| 50% | 25% | 25% | 0% | 0% | 0.06 mg/cm$^2$ | 2 | 222°C | 3°C | 219°C |
| 100% | 100% | 0% | 0% | 0% | 0.45 mg/cm$^2$ | 1 | 231°C | 0°C | 231°C |
| 100% | 50% | 50% | 0% | 0% | 0.23 mg/cm$^2$ | 2 | 231°C | 3°C | 228°C |
| 100% | 34% | 33% | 33% | 0% | 0.16 mg/cm$^2$ | 3 | 231°C | 6°C | 225°C |
| 100% | 25% | 25% | 25% | 25% | 0.13 mg/cm$^2$ | 4 | 231°C | 9°C | 222°C |
| 150% | 100% | 50% | 0% | 0% | 0.57 mg/cm$^2$ | 2 | 240°C | 3°C | 237°C |
| 150% | 50% | 50% | 50% | 0% | 0.35 mg/cm$^2$ | 3 | 240°C | 6°C | 234°C |
| 150% | 37% | 38% | 37% | 38% | 0.27 mg/cm$^2$ | 4 | 240°C | 9°C | 231°C |
| 200% | 100% | 100% | 0% | 0% | 0.90 mg/cm$^2$ | 2 | 249°C | 3°C | 246°C |
| 200% | 66% | 67% | 67% | 0% | 0.61 mg/cm$^2$ | 3 | 249°C | 6°C | 243°C |
| 200% | 50% | 50% | 50% | 50% | 0.47 mg/cm$^2$ | 4 | 249°C | 9°C | 240°C |
| 250% | 100% | 100% | 50% | 0% | 1.02 mg/cm$^2$ | 3 | 258°C | 6°C | 252°C |
| 250% | 63% | 63% | 62% | 62% | 0.72 mg/cm$^2$ | 4 | 258°C | 9°C | 249°C |
| 250% | 75% | 75% | 75% | 25% | 0.80 mg/cm$^2$ | 4 | 258°C | 9°C | 249°C |
| 300% | 100% | 100% | 100% | 0% | 1.35 mg/cm$^2$ | 3 | 267°C | 6°C | 261°C |
| 300% | 75% | 75% | 75% | 75% | 1.03 mg/cm$^2$ | 4 | 267°C | 9°C | 258°C |
| 300% | 100% | 100% | 50% | 50% | 1.13 mg/cm$^2$ | 4 | 267°C | 9°C | 258°C |

FIG.17

| | MAXIMUM SUM IMAGE DENSITY VALUE DSUM_MAX | IMAGE DENSITY VALUE OF EACH COLOR | | | | MAXIMUM SUM TONER BEARING AMOUNT WSUM_MAX | TONER COEFFICIENT E | SET TEMPERATURE T |
|---|---|---|---|---|---|---|---|---|
| | | DY | DM | DC | DK | | | |
| | 50% | 50% | 0% | 0% | 0% | 0.12 mg/cm$^2$ | 1 | 220°C |
| | 50% | 25% | 25% | 0% | 0% | 0.06 mg/cm$^2$ | 2 | 217°C |
| | 100% | 100% | 0% | 0% | 0% | 0.45 mg/cm$^2$ | 1 | 238°C |
| | 100% | 50% | 50% | 0% | 0% | 0.23 mg/cm$^2$ | 2 | 227°C |
| | 100% | 34% | 33% | 33% | 0% | 0.16 mg/cm$^2$ | 3 | 223°C |
| | 100% | 25% | 25% | 25% | 25% | 0.13 mg/cm$^2$ | 4 | 221°C |
| | 150% | 100% | 50% | 0% | 0% | 0.57 mg/cm$^2$ | 2 | 243°C |
| | 150% | 50% | 50% | 50% | 0% | 0.35 mg/cm$^2$ | 3 | 233°C |
| | 150% | 37% | 38% | 37% | 38% | 0.27 mg/cm$^2$ | 4 | 229°C |
| (B-1) | 200% | 100% | 100% | 0% | 0% | 0.90 mg/cm$^2$ | 2 | 256°C |
| (B-2) | 200% | 66% | 67% | 67% | 0% | 0.61 mg/cm$^2$ | 3 | 245°C |
| (B-3) | 200% | 50% | 50% | 50% | 50% | 0.47 mg/cm$^2$ | 4 | 239°C |
| | 250% | 100% | 100% | 50% | 0% | 1.02 mg/cm$^2$ | 3 | 259°C |
| | 250% | 63% | 63% | 62% | 62% | 0.72 mg/cm$^2$ | 4 | 250°C |
| | 250% | 75% | 75% | 75% | 25% | 0.80 mg/cm$^2$ | 4 | 253°C |
| | 300% | 100% | 100% | 100% | 0% | 1.35 mg/cm$^2$ | 3 | 267°C |
| | 300% | 75% | 75% | 75% | 75% | 1.03 mg/cm$^2$ | 4 | 260°C |
| | 300% | 100% | 100% | 50% | 50% | 1.13 mg/cm$^2$ | 4 | 262°C |

B

FIG.19

| | | MAXIMUM SUM IMAGE DENSITY VALUE DSUM_MAX | IMAGE DENSITY VALUE OF EACH COLOR | | | | SUM TONER BEARING AMOUNT |
|---|---|---|---|---|---|---|---|
| | | | DY | DM | DC | DK | |
| SECOND EMBODIMENT | CONDITION A | 200% | 100% | 100% | 0% | 0% | 0.90mg/cm$^2$ |
| | CONDITION B | 200% | 66% | 67% | 67% | 0% | 0.61mg/cm$^2$ |
| | CONDITION C | 200% | 50% | 50% | 50% | 50% | 0.47mg/cm$^2$ |
| | | SET TEMPERATURE T | FILM SURFACE TEMPERATURE | | POWER CONSUMPTION | | FIXABILITY |
| SECOND EMBODIMENT | CONDITION A | 256°C | 170°C | | 680W | | GOOD |
| | CONDITION B | 245°C | 159°C | | 659W | | GOOD |
| | CONDITION C | 239°C | 154°C | | 639W | | GOOD |

IMAGE FORMING APPARATUS AND IMAGE FORMING METHOD

BACKGROUND OF THE INVENTION

Field of the Invention

The present invention relates to an image forming apparatus using an electrophotographic system such as printers including a laser printer and an LED printer, digital copiers, and the like, an image forming method, and a program.

Description of the Related Art

In conventional image forming apparatuses using an electrophotographic system, there is a technique for controlling a set temperature of a heating apparatus that heats and melts toner on a recording material in accordance with an amount of image data to be printed. Japanese Patent Application Laid-open No. 2016-4231 discloses a method of dividing image data into areas constituted by 32 dots×32 dots or the like and determining a set temperature on the basis of an image data amount of an area with a largest image data amount out of all areas and a print percentage of an entire image. A fixing process is performed by raising the set temperature when a maximum image data amount is large but by lowering the set temperature when the maximum image data amount is small. Accordingly, fixing at an unnecessarily high set temperature with respect to a toner image is avoided in order to reduce power consumption of the heating apparatus.

SUMMARY OF THE INVENTION

When printing is performed by overlapping toners of a plurality of colors on a recording material as in the case of a color image forming apparatus, even when a sum value of image density of image data is the same, an amount of unfixed toner that is actually laid onto the recording material may differ. Therefore, when a set temperature of a heating apparatus is determined in accordance with a sum value of image density in image data, an excessive amount of heat may be supplied to a recording material and the heating apparatus may end up consuming an excessive amount of power.

An object of the present invention is to reduce power consumption by more suitably controlling a set temperature of a heating apparatus in accordance with the number of colors of toners.

In order to achieve the object described above, an image forming apparatus including:

a fixing portion configured to fix a toner image formed in accordance with image data to a recording material;

a determining portion configured to acquire a density value indicating image density represented by the image data for each of colors of toners constituting the toner image, obtain a sum value of the density values with respect to the colors of the toners, obtain a numerical value indicating the number of the density values being values larger than 0 out of the density values corresponding to the colors of the toners, and determine a target temperature for maintaining a temperature of the fixing portion on the basis of the sum value and the numerical value; and a control portion configured to control power to be supplied to the fixing portion so that the temperature of the fixing portion is maintained at the target temperature, wherein in a case the sum value is a first value and the numerical value is a first number, the determining portion determines a first temperature as the target temperature, in a case the sum value is the first value and the numerical value is a second number that is larger than the first number, the determining portion determines a second temperature that is lower than the first temperature as the target temperature.

In order to achieve the object described above, an image forming apparatus including:

a fixing portion configured to fix a toner image formed in accordance with image data to a recording material;

a determining portion configured to acquire a density value indicating image density represented by the image data for each of colors of toners constituting the toner image, calculate a toner bearing amount for the each of the colors of the toners from the density values with respect to the respective colors of the toners, obtain a sum amount of the toner bearing amounts with respect to the respective colors of the toners, and determine a target temperature for maintaining a temperature of the fixing portion on the basis of the sum amount; and a control portion configured to control power to be supplied to the fixing portion so that the temperature of the fixing portion is maintained at the target temperature.

In order to achieve the object described above, an image forming method, causing a computer included in an image forming apparatus to perform:

a fixing step of fixing a toner image formed in accordance with image data to a recording material using a fixing portion;

a determining step of acquiring a density value indicating image density represented by the image data for respective colors of toners constituting the toner image, obtaining a sum value of the density values with respect to the respective colors of the toners, obtaining a numerical value indicating the number of the density values being values larger than 0 out of the density values corresponding to the respective colors of the toners, and determining a target temperature for maintaining a temperature of the fixing portion on the basis of the sum value and the numerical value; and a controlling step of controlling power to be supplied to the fixing portion so that the temperature of the fixing portion is maintained at the target temperature, wherein the determining step includes, in a case the sum value is a first value and the numerical value is a first number, determining a first temperature as the target temperature, in a case the sum value is the first value and the numerical value is a second number that is larger than the first number, determining a second temperature that is lower than the first temperature as the target temperature.

In order to achieve the object described above, an image forming method, causing a computer included in an image forming apparatus to perform:

a fixing step of fixing a toner image formed in accordance with image data to a recording material using a fixing portion;

a determining step of acquiring a density value indicating image density represented by the image data for respective colors of toners constituting the toner image, calculating a toner bearing amount for the respective colors of the toners from the density value with respect to the respective colors of the toners, obtaining a sum amount of the toner bearing amounts with respect to the respective colors of the toners, and determining a target temperature for maintaining a temperature of the fixing portion on the basis of the sum amount; and a controlling step of controlling power to be supplied to the fixing portion so that the temperature of the fixing portion is maintained at the target temperature.

According to the present invention, power consumption can be reduced by more suitably controlling a set temperature of a heating apparatus in accordance with the number of colors of toners.

Further features of the present invention will become apparent from the following description of exemplary embodiments with reference to the attached drawings.

BRIEF DESCRIPTION OF THE DRAWINGS

FIG. 8 is a table showing an example of temperature control parameters according to the first embodiment;

FIGS. 11A to 11C are tables showing a result of a comparative experiment according to the first embodiment;

FIGS. 12A and 12B are tables illustrating a first modification;

FIG. 13 is a table showing an example of temperature control parameters according to the first modification;

FIG. 17 is a table showing an example of temperature control parameters according to the second embodiment;

FIG. 19 is a table showing a result of a comparative experiment according to the second embodiment.

DESCRIPTION OF THE EMBODIMENTS

Hereinafter, embodiments of the present invention will be described in detail with reference to the drawings. However, it is to be understood that dimensions, materials, shapes, relative arrangements, and the like of components described in the embodiments are intended to be changed as deemed appropriate in accordance with configurations and various conditions of apparatuses to which the present invention is to be applied and are not intended to limit the scope of the present invention to the embodiments described below.

First Embodiment

Description of Image Forming Apparatus

Figure 1A:
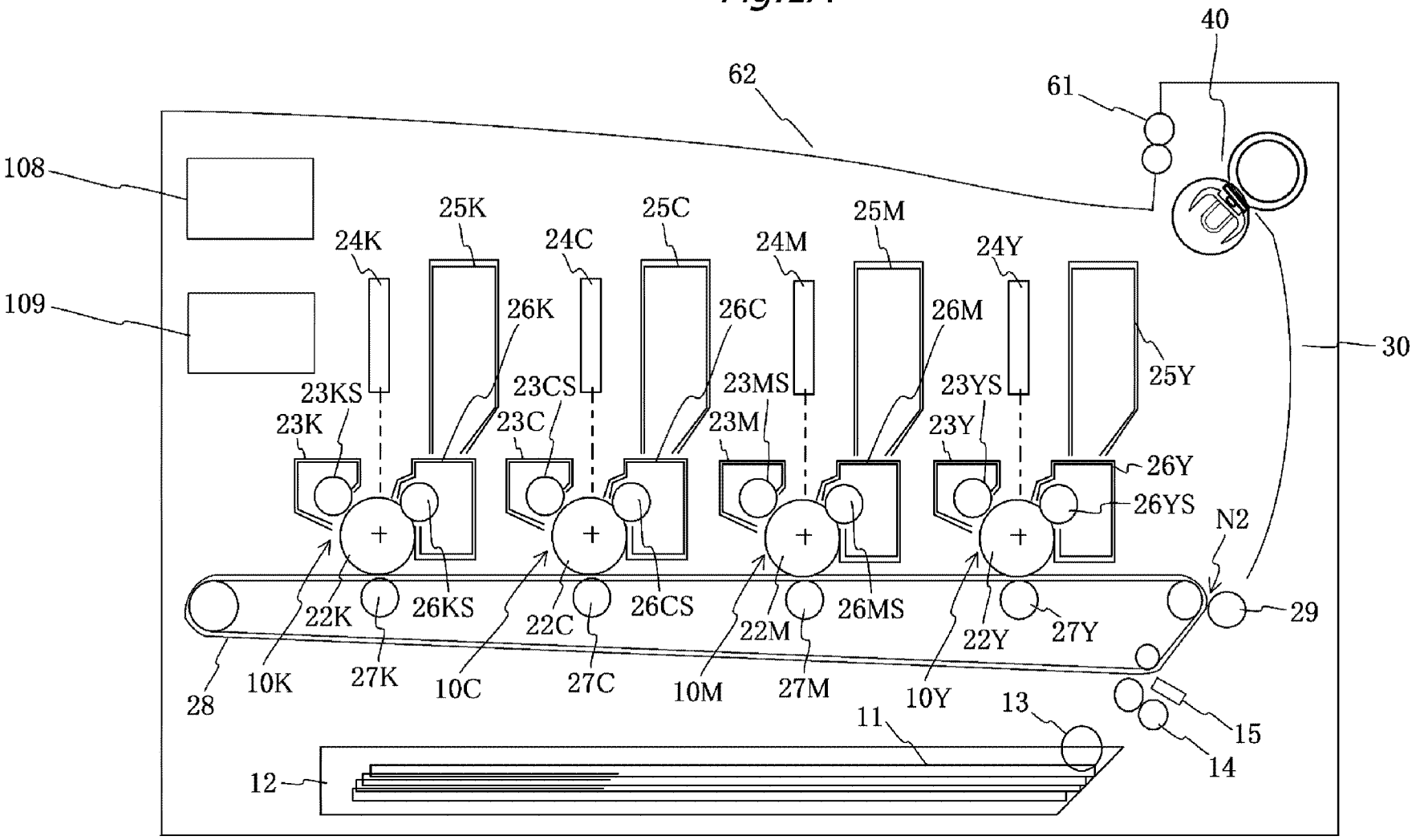
FIG. 1A is a sectional view of an image forming apparatus according to a first embodiment.

A configuration of a color image forming apparatus (hereinafter, expressed as an image forming apparatus) 1 according to a first embodiment will be described with reference to FIG. 1A. FIG. 1A is a sectional view of the image forming apparatus 1 according to the first embodiment. The image forming apparatus 1 includes a paper feeding tray 12, a paper feeding roller 13, a resist roller pair 14, and a registration sensor 15. The image forming apparatus 1 includes an image forming portion constituted by image forming stations 10Y, 10M, 10C, and 10K for forming toner images of each of the colors yellow (Y), magenta (M), cyan (C), and black (K) on a recording material (a recording medium) 11. In the first embodiment, the image forming stations 10Y, 10M, 10C, and 10K are arranged in a single row in a direction intersecting a vertical direction. Each of the image forming stations 10Y, 10M, 10C, and 10K has a photosensitive drum 22Y, 22M, 22C, or 22K, an injection charger 23Y, 23M, 23C, or 23K as primary charging portions, and a scanner portion 24Y, 24M, 24C, or 24K as exposing portions. In addition, each of the image forming stations 10Y, 10M, 10C, and 10K has a toner cartridge 25Y, 25M, 25C, or 25K, developing portions 26Y, 26M, 26C, or 26K, and a primary transfer roller 27Y, 27M, 27C, or 27K. The image forming apparatus 1 includes an intermediate transfer belt 28, a secondary transfer roller 29, a heating apparatus (a fixing apparatus) 40, a paper discharge roller pair 61, a control portion 108, and a video controller 109. The video controller 109 receives image data (image information) and print instruction signals transmitted from an external apparatus such as a personal computer. The control portion 108 is connected to the video controller 109 and controls respective portions constituting the image forming apparatus 1 in accordance with instructions from the video controller 109.

The image forming portion forms an electrostatic latent image by exposure light having been lighted on the basis of an exposure time calculated by the control portion 108 as an image processing portion, and develops the electrostatic latent image to form a monochrome toner image. In addition, the image forming portion superimposes monochrome toner images to form a multicolor toner image, and transfers the multicolor toner image onto the recording material 11. The multicolor toner image on the recording material 11 is fixed to the recording material 11 by the heating apparatus 40.

The photosensitive drums 22Y, 22M, 22C, and 22K are constructed by applying an organic photoconductive layer on an outer circumference of an aluminum cylinder, and rotate as a driving force of a drive motor (not illustrated) is transmitted thereto. The drive motor rotates the photosensitive drums 22Y, 22M, 22C, and 22K in a clockwise direction in accordance with an image forming operation. The injection chargers 23Y, 23M, 23C, and 23K are provided with sleeves 23YS, 23MS, 23CS, and 23KS respectively corresponding thereto. The injection chargers 23Y, 23M, 23C, and 23K charge the photosensitive drums 22Y, 22M, 22C, and 22K. Exposure light is irradiated to the photosensitive drums 22Y, 22M, 22C, and 22K from the scanner portions 24Y, 24M, 24C, and 24K to selectively expose surfaces of the photosensitive drums 22Y, 22M, 22C, and 22K. Accordingly, an electrostatic latent image is formed on the photosensitive drums 22Y, 22M, 22C, and 22K.

The developing portions 26Y, 26M, 26C, and 26K develop yellow (Y), magenta (M), cyan (C), and black (K) in order to visualize the electrostatic latent images formed on the photosensitive drums 22Y, 22M, 22C, and 22K. The developing portions 26Y, 26M, 26C, and 26K are provided with sleeves 26YS, 26MS, 26CS, and 26KS respectively corresponding thereto. In addition, a power supply (not illustrated) applies a developing bias between the sleeves 26YS, 26MS, 26CS, and 26KS and the photosensitive drums 22Y, 22M, 22C, and 22K respectively corresponding thereto. During image formation, the photosensitive drums 22Y, 22M, 22C, and 22K rotate clockwise, and the developing portions 26Y, 26M, 26C, and 26K supply toner to the electrostatic latent images formed on the photosensitive drums 22Y, 22M, 22C, and 22K. Accordingly, a toner image of each color (hereinafter, also referred to as a multicolor toner image) is formed on the photosensitive drums 22Y, 22M, 22C, and 22K in accordance with image data transmitted from an external apparatus.

The intermediate transfer belt 28 is in contact with the photosensitive drums 22Y, 22M, 22C, and 22K due to a pressing force of the primary transfer rollers 27Y, 27M, 27C, and 27K. In addition, a power supply (not illustrated) applies a primary transfer bias between the primary transfer rollers 27Y, 27M, 27C, and 27K and the photosensitive drums 22Y, 22M, 22C, and 22K respectively corresponding thereto. During image formation, the intermediate transfer belt 28 and the primary transfer rollers 27Y, 27M, 27C, and 27K rotate so as to follow the photosensitive drums 22Y, 22M, 22C, and 22K and primarily transfer the toner images on the photosensitive drums 22Y, 22M, 22C, and 22K onto the intermediate transfer belt 28.

The recording material 11 housed in the paper feeding tray 12 is transported by the paper feeding roller 13 and reaches the resist roller pair 14. The registration sensor 15 detects a leading end or a trailing end of the recording material 11. During image formation, the recording material 11 is transported so as coincide with a timing of detection by the registration sensor 15 to a timing where the multicolor toner image on the intermediate transfer belt 28 arrives at the secondary transfer roller 29. In this manner, the recording material 11 arrives at the secondary transfer roller 29 from the resist roller pair 14 at an appropriate timing.

The intermediate transfer belt 28 is sandwiched by a pair of the secondary transfer rollers 29. Accordingly, a secondary transfer nip portion N2 as a secondary transfer portion is formed between the intermediate transfer belt 28 and the secondary transfer rollers 29. In the secondary transfer nip portion N2, the secondary transfer rollers 29 come into contact with the intermediate transfer belt 28, sandwiches and transports the recording material 11, and transfers the multicolor toner image on the intermediate transfer belt 28 to the recording material 11. A power supply (not illustrated) applies a secondary transfer bias between the secondary transfer rollers 29 and the intermediate transfer belt 28. The transport guide 30 is a guiding member for transporting the recording material 11 from the secondary transfer nip portion N2 to the heating apparatus 40.

The heating apparatus 40 is a fixing portion which sandwiches and transports the recording material 11, heats and melts a toner image on the recording material 11, and fixes the toner image to the recording material 11. The recording material 11 subjected to a fixing process by the heating apparatus 40 is transported to the outside of the image forming apparatus 1 by the paper discharge roller pair 61 and discharged to a paper discharge tray 62. An image forming operation ends as the recording material 11 is discharged to the paper discharge tray 62.

Hardware Configuration of Image Forming Apparatus

Figure 1B:
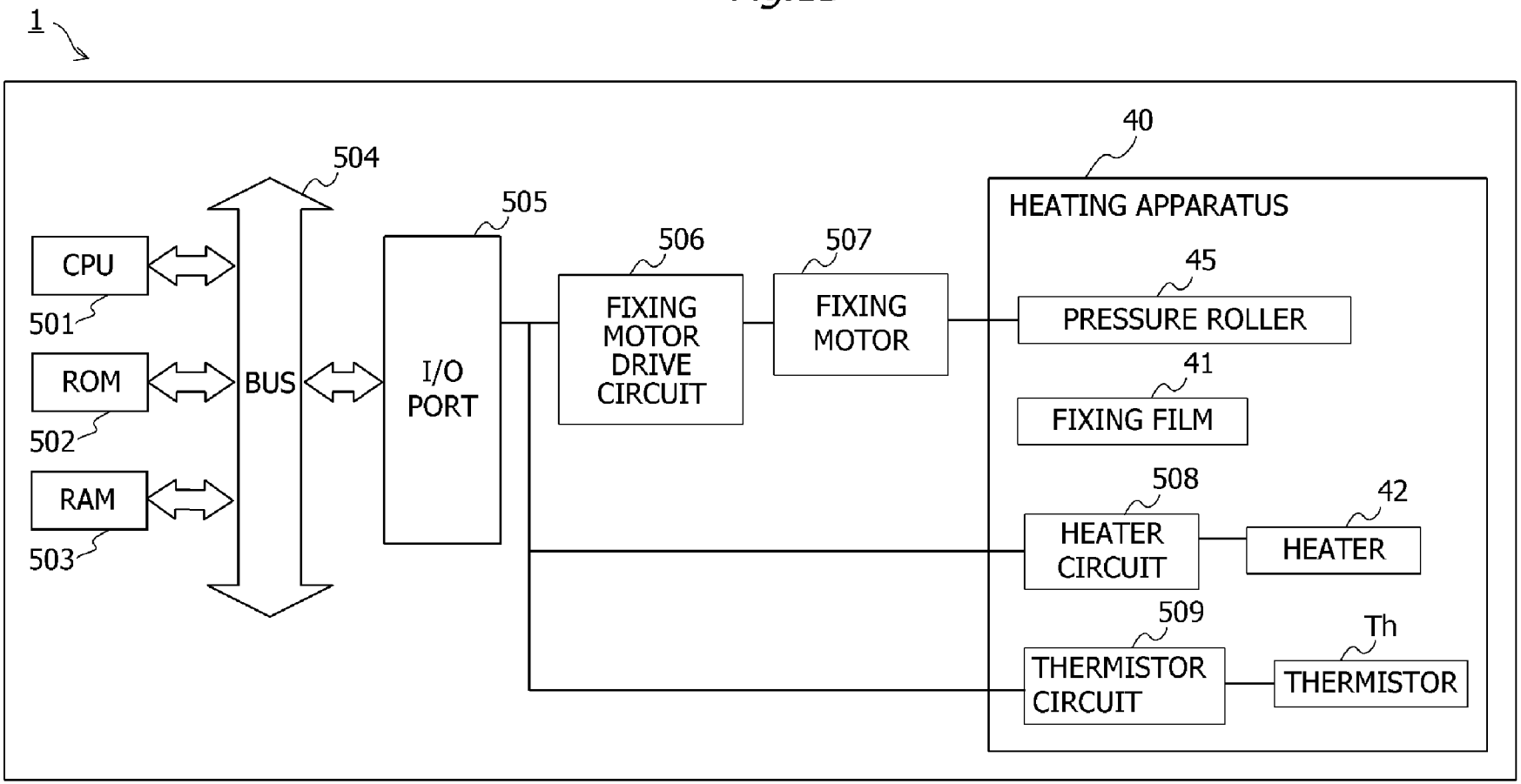
FIG. 1B is a hardware configuration diagram of the image forming apparatus according to the first embodiment.

FIG. 1B is a hardware configuration diagram of the image forming apparatus 1 according to the first embodiment. The image forming apparatus 1 includes a CPU 501, a ROM 502, a RAM 503, a bus 504, an I/O port 505, a fixing motor drive circuit 506, a fixing motor 507, and the heating apparatus 40. The heating apparatus 40 has a fixing film 41, a pressure roller 45, a heater 42, a thermistor Th, a heater circuit 508, and a thermistor circuit 509. In order to drive the pressure roller 45, the CPU 501 outputs a signal to the fixing motor drive circuit 506 via the bus 504 and the I/O port 505 to drive the fixing motor 507. The fixing film 41 rotates so as to follow a rotation of the pressure roller 45. The CPU 501 acquires a temperature detected by the thermistor Th via the bus 504, the I/O port 505, and the thermistor circuit 509. The CPU 501 causes the heater 42 to generate heat via the bus 504, the I/O port 505, and the heater circuit 508 in order to perform temperature control.

Functional Configuration of Control Portion

Figure 1C:
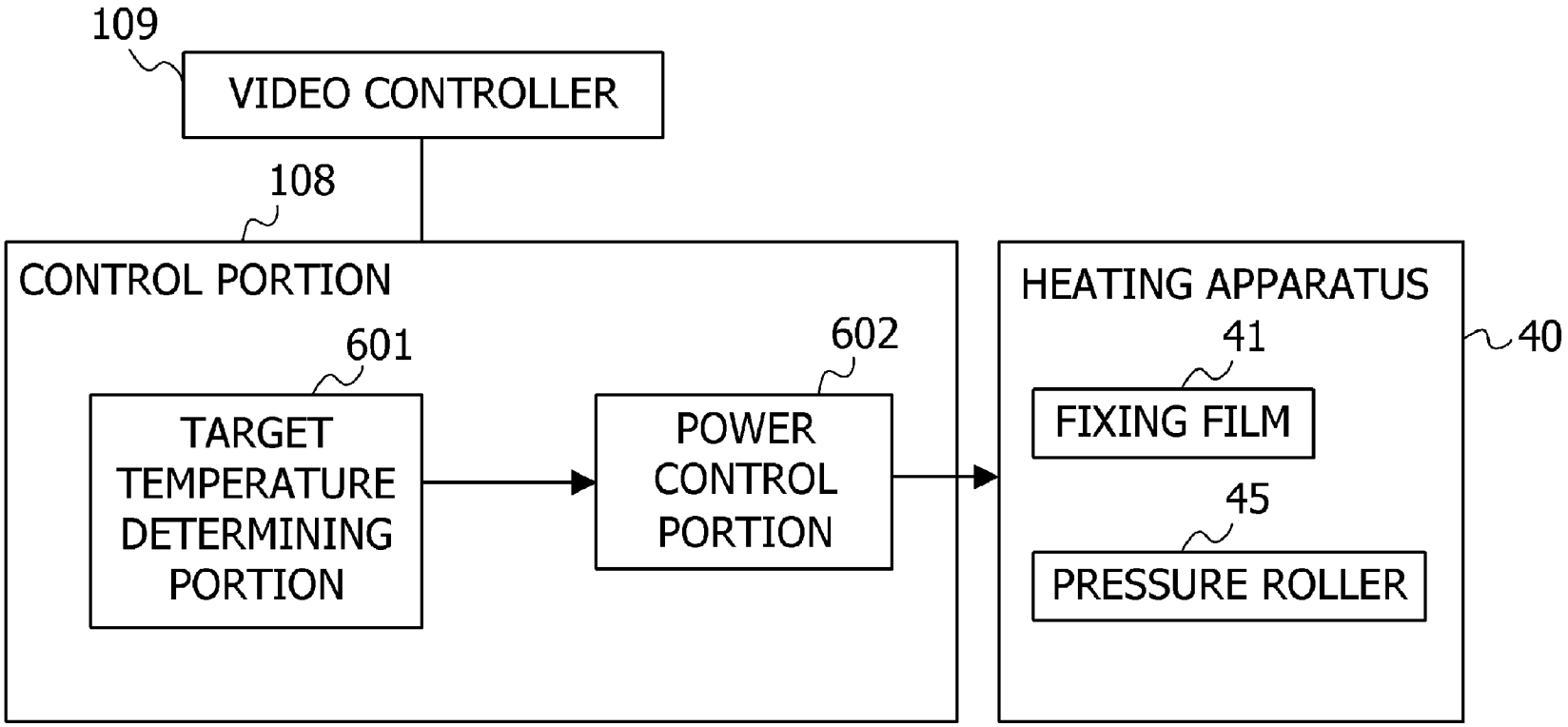
FIG. 1C is a functional block diagram of a control portion according to the first embodiment.

Next, a functional configuration of the control portion 108 will be described. FIG. 1C is a functional block diagram of the control portion 108 according to the first embodiment. As shown in FIG. 1C, the control portion 108 has a target temperature determining portion 601 and a power control portion 602. The target temperature determining portion 601 and the power control portion 602 are realized as the CPU 501 shown in FIG. 1B executes a program stored in the ROM 502. The target temperature determining portion 601 determines a target temperature (a set temperature of the heating apparatus 40) for maintaining the temperature of the heating apparatus 40. The power control portion 602 controls power supplied to the heating apparatus 40 so that the temperature of the heating apparatus 40 is maintained at the target temperature.

Description of Configuration of Heating Apparatus

Figure 2A:
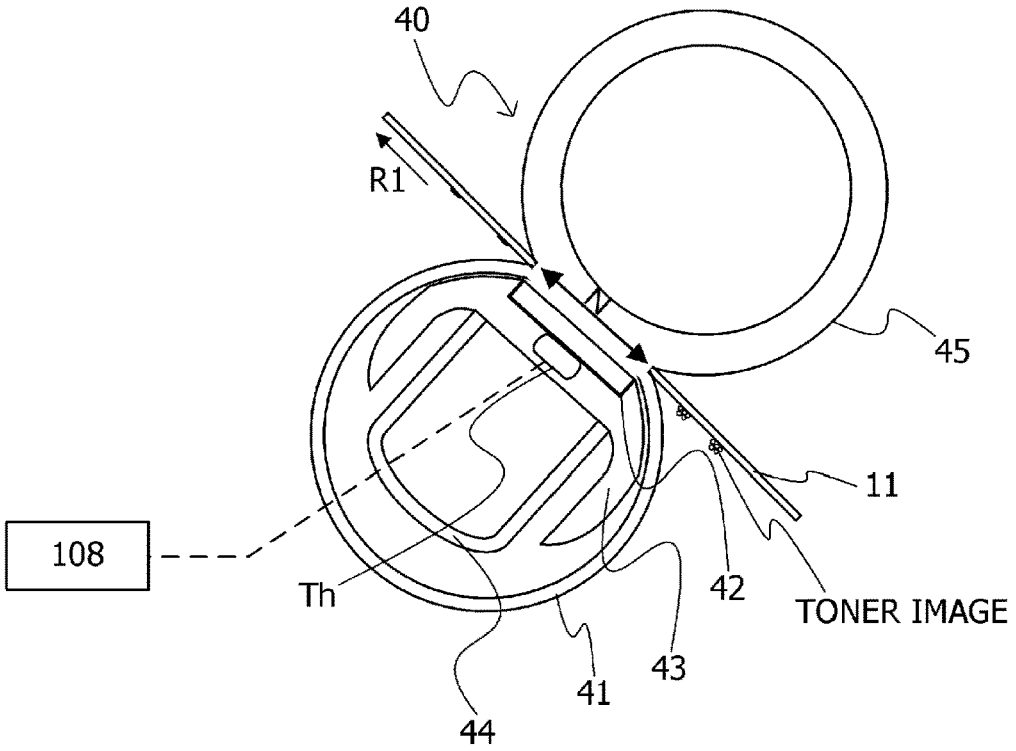
FIGS. 2A and 2B are sectional views of a heating apparatus according to the first embodiment.

Next, the heating apparatus 40 will be described with reference to FIG. 2A. The heating apparatus 40 includes the fixing film 41 as a fixing member, the heater 42 as a heating member that comes into contact with an inner surface of the fixing film 41, and the pressure roller 45 as a pressing member. The heater 42 is held by a holding member 43 which also has a guiding function for guiding rotation of the fixing film 41. A stay 44 is a member for applying pressure of a pressure spring (not illustrated) to the holding member 43 toward a side of the pressure roller 45 to form a fixing nip portion N for heating and fixing a toner image on the recording material 11. For example, the stay 44 is formed by a metal with high rigidity. In this case, total pressure of the pressure spring is 250 N, and a width of the fixing nip portion N in a transport direction of the recording material 11 (hereinafter, expressed as a recording material transport direction) is set to 9.0 mm. The pressure roller 45 receives power from a motor (not illustrated) and rotates clockwise. Due to the rotation of the pressure roller 45, the fixing film 41 rotates counterclockwise so as to follow the rotation of the pressure roller 45. The recording material 11 bearing a toner image is heated while being sandwiched and transported in a direction R1 at the fixing nip portion N to perform a fixing process of the toner image on the recording material 11.

The fixing film 41 has, for example, an outer diameter of 24 mm and has a base layer made of polyimide resin with a thickness of 60 μm, an elastic layer made of a thermally-conductive rubber layer with a thickness of 200 μm on an outer side of the base layer, and a releasing layer made of a PFA tube with a thickness of 20 μm as an outermost layer. In addition, the pressure roller 45 has, for example, an outer diameter of 25 mm and has a steel core with an outer diameter of 19 mm, an elastic layer made of silicone rubber with a thickness of 3 mm, and a releasing layer made of a PFA tube with a thickness of 40 μm as an outermost layer. The thermistor Th as a temperature detecting portion of the heater 42 is installed on a rear surface side of the heater 42, and the thermistor Th is connected to the control portion 108. During normal use, a driven rotation of the fixing film 41 starts as a rotation of the pressure roller 45 starts, and an inner surface temperature of the fixing film 41 rises as a temperature of the heater 42 rises. The heater 42 is controlled by the control portion 108 as a temperature control portion and a power control portion, and the set temperature (target temperature) of the heating apparatus 40 is determined and input power to the heater 42 is controlled so that a surface temperature of the fixing film 41 reaches a prescribed temperature. In other words, on the basis of a detected temperature of the thermistor Th, the control portion 108 performs power control of the heater 42 so that the temperature of the heating apparatus 40 (the surface temperature of the fixing film 41) is maintained at the set temperature. For example, the heater 42 may be controlled by the control portion 108 by controlling power supplied to the heater 42 in accordance with a signal of the thermistor Th. Due to the heater 42 being controlled in this manner, temperature control of the heating apparatus 40 is performed by holding the temperature inside the fixing nip portion N (a fixing temperature, a heating temperature) during a heating-fixing operation at a desired temperature (a target temperature). In other words, the heater 42 is controlled so that the temperature detected by the thermistor Th is maintained at the set temperature of the heating apparatus 40. Alternatively, the heater 42 may be controlled so that the temperature detected by the thermistor Th is kept within an allowable range (a prescribed temperature range) of the set temperature of the heating apparatus 40.

Figure 2B:
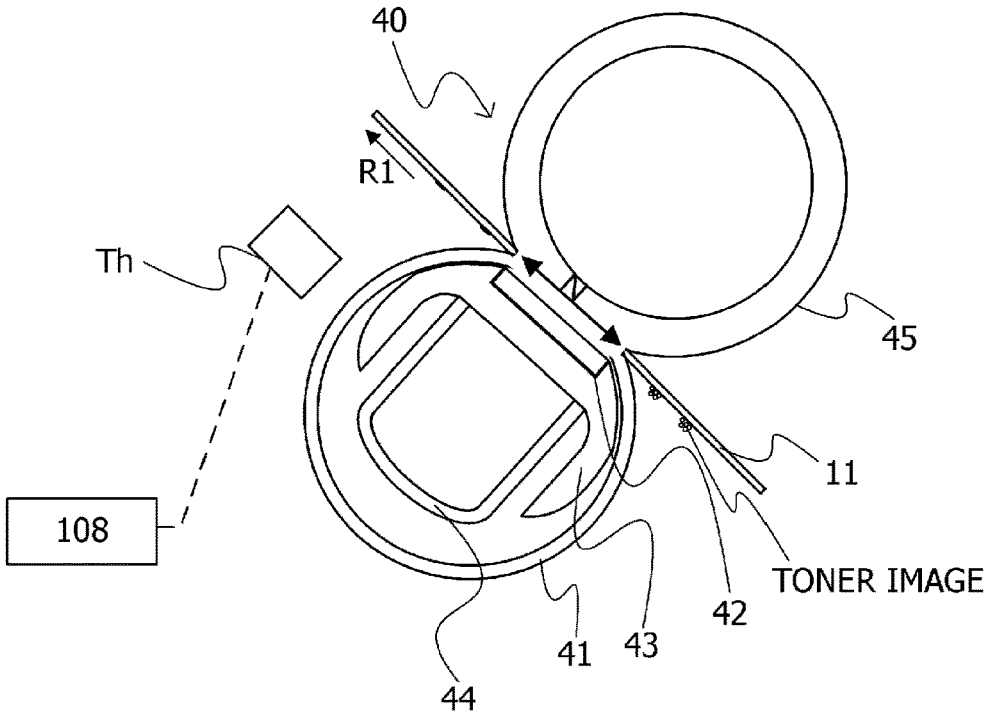

The thermistor Th is arranged so as to come into contact with a center position of the heater 42 in a longitudinal direction of the heater 42 and a center position of the heater 42 in a transverse direction of the heater 42. The longitudinal direction of the heater 42 is a direction perpendicular to the recording material transport direction. The transverse direction of the heater 42 is a direction perpendicular to the longitudinal direction of the heater 42 and coincides with the recording material transport direction. In the first embodiment, as shown in FIG. 2A, temperature control of the heating apparatus 40 is performed by bringing the thermistor Th as a temperature detecting portion into contact with a rear surface of the heater 42 as a heating portion and controlling the heater 42. In addition, as shown in FIG. 2B, by using the thermistor Th as a contactless temperature detecting portion that detects infrared rays or visible light rays, the thermistor Th may be arranged in a state where the heater 42 and the thermistor Th are separated from each other.

Figure 3A:
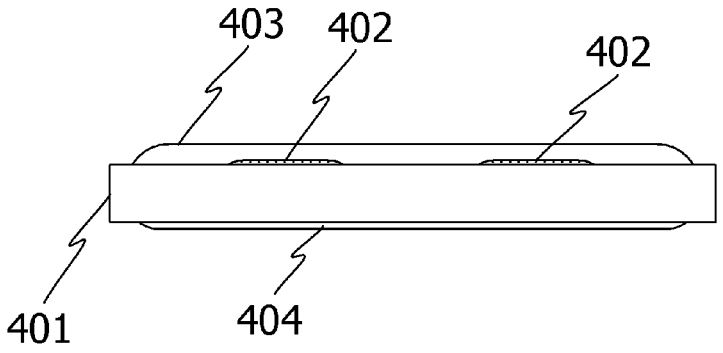
FIGS. 3A and 3B are schematic views showing a configuration of a heater according to the first embodiment.
Figure 3B:
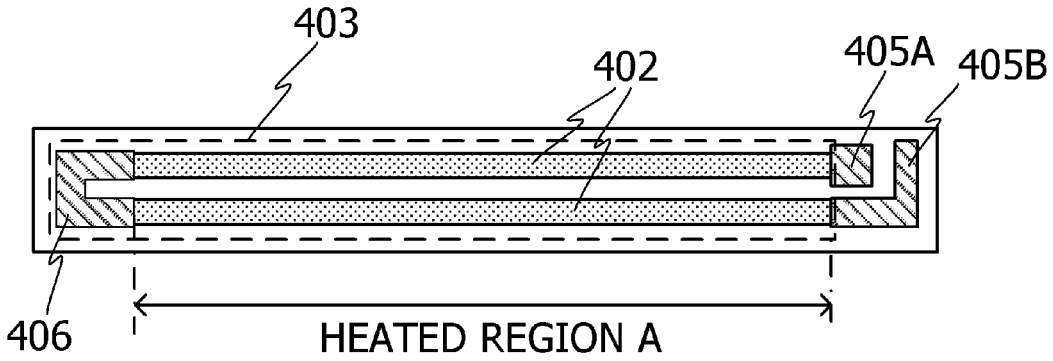

A configuration of the heater 42 will be described with reference to the schematic views of FIGS. 3A and 3B. FIG. 3A is a sectional view of the heater 42. An aluminum nitride base material 401 of the heater 42 is constituted by an aluminum nitride substrate that is a ceramic substrate with a thickness of 0.6 mm. For example, a longitudinal width of the aluminum nitride base material 401 is 260 mm and a transverse width (a paper-passing direction) thereof is 9 mm A sliding glass layer 404 with a thickness of 15 μm is provided on a front surface side of the heater 42 which comes into contact with the fixing film 41. The sliding glass layer 404 comes into contact with the fixing film 41 via a fluorine grease (not illustrated) and exhibits favorable slidability. In addition, a resistance heating layer 402 with a thickness of 10 μm and protective glass 403 with a thickness of 50 μm are provided on a rear surface side of the heater 42. The resistance heating layer 402 is formed by applying a conductive paste containing a silver-palladium (Ag/Pd) alloy on the aluminum nitride base material 401 by screen printing. FIG. 3B is a schematic view of the heater 42 when viewed from the rear surface side of the heater 42. The resistance heating layer 402 is formed in a band shape along the longitudinal direction of the heater 42. A dotted line in FIG. 3B denotes the protective glass 403. Due to the protective glass 403 covering the resistance heating layer 402 and a conductive portion 406, insulation properties of the resistance heating layer 402 and the conductive portion 406 are secured. In addition, in the heater 42, the resistance heating layer 402 generates heat when electrode portions 405A and 405B are energized by an external power supply. In this case, in the longitudinal direction of the heater 42, a heated region A that is heated by the resistance heating layer 402 is, for example, 220 mm In the first embodiment, power-supply voltage of the external power supply is 120 V and resistance of the heater 42 is set to 10Ω. In order to measure power (to be described later), the external power supply is connected to cables (not illustrated) for feeding power to the electrode portions 405A and 405B via a power meter WT310 manufactured by Yokogawa Test & Measurement Corporation.

<Description of Temperature Control of Heating Apparatus>

Figure 4:
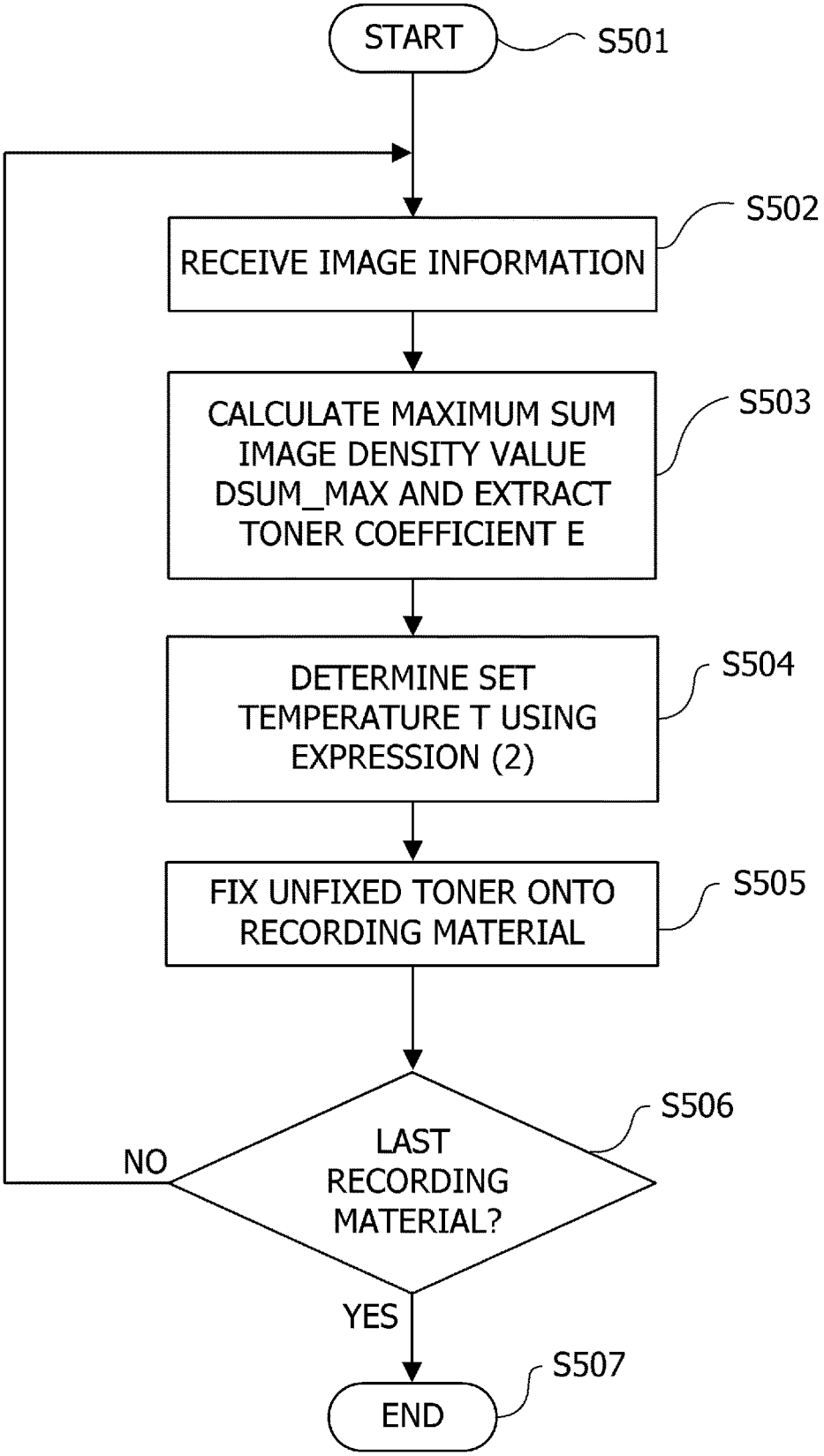
FIG. 4 is a flow chart showing a temperature control method of the heating apparatus according to the first embodiment.

Temperature control of the heating apparatus 40 on the basis of an image density value and the number of colors of toners which is a feature of the first embodiment will now be described in detail with reference to the flow chart in FIG. 4. In the first embodiment, a method will be described of extracting a maximum sum image density value Dsum_max and a toner coefficient E indicating the number of colors of toners constituting a toner image from image data received by the video controller 109 and reflecting the maximum sum image density value Dsum_max and the toner coefficient E on a set temperature T of the heating apparatus 40. The maximum sum image density value Dsum_max will be described later. In FIG. 4, printing is started as the image forming apparatus 1 receives a print job (S501). The video controller 109 as an image data detecting portion receives image data (S502). The control portion 108 calculates the maximum sum image density value Dsum_max of the recording material 11 to pass through the heating apparatus 40 next from the image data and extracts the toner coefficient E (S503). The toner coefficient is an example of the numerical value.

Figure 5A:
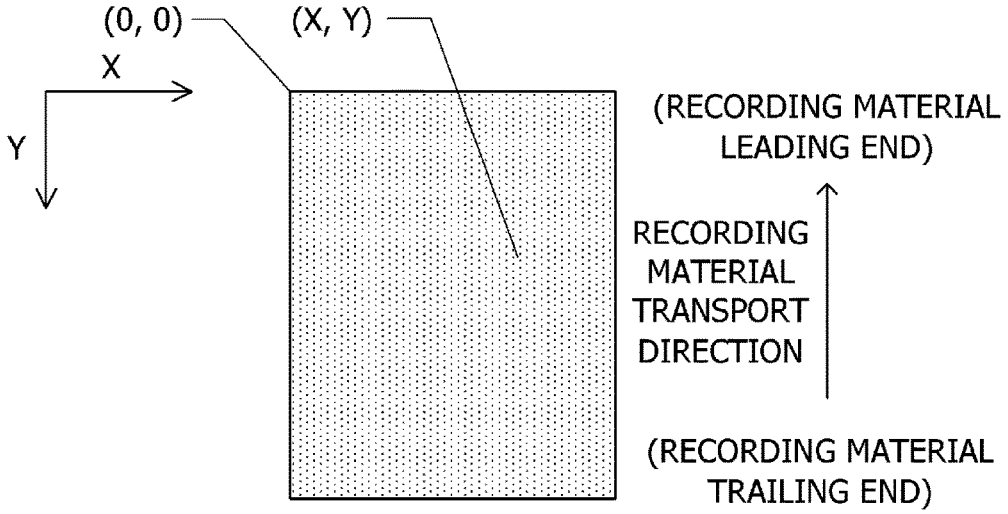
FIGS. 5A to 5C are schematic views for illustrating image data of a recording material.

The maximum sum image density value Dsum_max will now be described. FIG. 5A is a schematic view for illustrating an image density value of each recording material 11. The longitudinal direction which is a print surface side of each recording material 11 and which is perpendicular to the recording material transport direction is adopted as X coordinates, the recording material transport direction is adopted as Y coordinates, and a left end of the X coordinates and a distal end of the Y coordinates are adopted as a coordinate origin (0, 0), whereby each pixel on X-Y coordinates at an image resolution of 600 dpi has image density. In this case, image density of 16 gradations can be expressed per pixel. With four pixels in all directions (a total of 16 pixels) on the X-Y coordinates as one pixel block, image density of 256 gradations (gradation data: 0 to 255) can be expressed within one pixel block and the image density is defined as an image density value of 0 to 100%. In other words, an image density value is a density value indicating image density expressed by image data and is a value indicating image density of image data (image information) as a percentage.

Figure 5B:
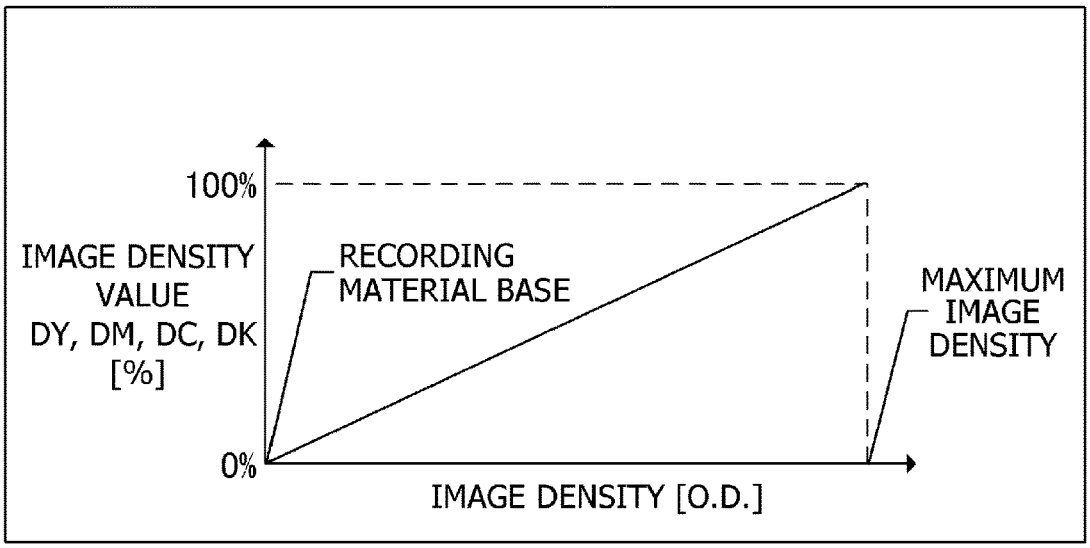
Figure 5C:
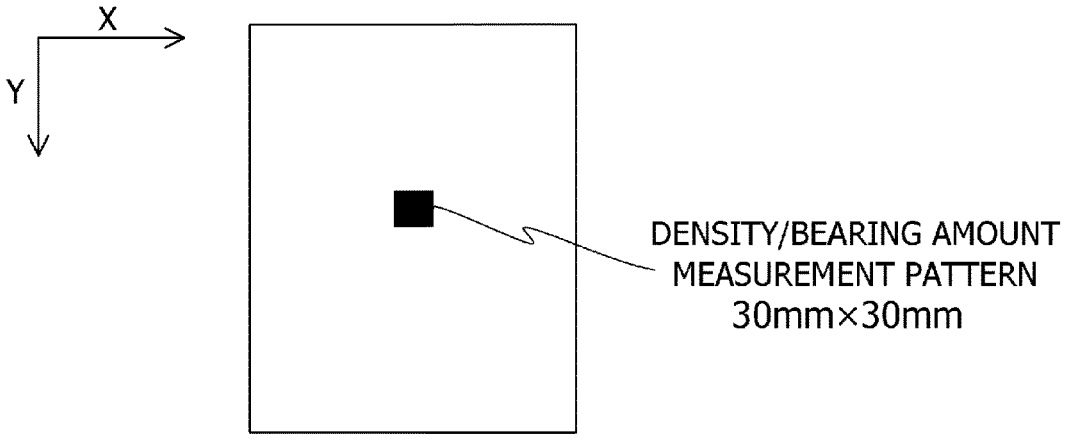
Figure 6A:
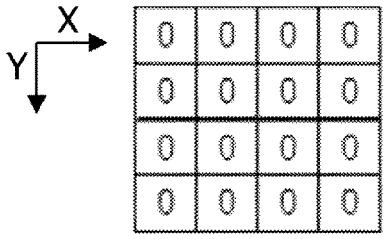
FIGS. 6A to 6E are diagrams showing a relationship between gradations and image density.
Figure 6B:
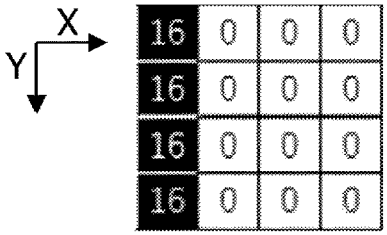
Figure 6C:
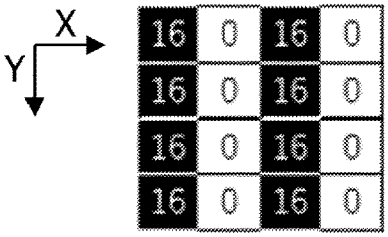
Figure 6D:
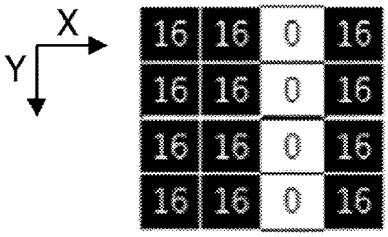
Figure 6E:
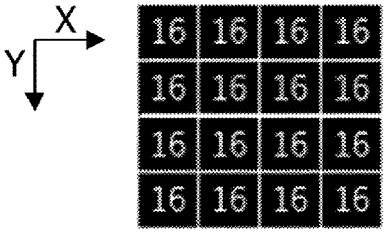

FIG. 6A shows image data in a case where image density value: 0% and gradation data: 0, and shows a state where toner is unused. FIG. 6E shows image data in a case where image density value: 100% and gradation data: 255, whereby image density value: 100% represents an upper limit value of the image density value of each color and a maximum image density (O.D.) in this case is approximately 1.4 (O.D.) for each color. FIGS. 6B to 6D indicate image data in cases where image density value: 25%, 50%, and 75% and gradation data: 63, 127, and 191. The halftones in FIGS. 6B to 6D are indicated by numerical values having been linearly interpolated with respect to image density. Image density (O.D.) is a measurement value obtained by measuring an output image from the image forming apparatus 1 according to the first embodiment using X-rite 504 as a spectral densitometer. In the first embodiment, while an image density value has a linear relationship with respect to image density as shown in FIG. 5B, this is not restrictive and, for example, an image density value may have a linear relationship with respect to color difference (ΔE). In addition, high white paper GF-0081, A4 size, manufactured by Canon Inc. was used as the recording material 11 and a 100% image pattern (30 mm×30 mm) of each color such as that shown in FIG. 5C was created at center of the A4-size recording material 11. Image creation was performed using YMCK color mode of Photoshop CS4 manufactured by Adobe Inc. In addition, a toner bearing amount (toner laid-on level) per unit area on the recording material 11 is approximately 0.45 (mg/cm$^2$) at an image density value of 100% for all colors. This numerical value is a measurement value obtained by performing a weight measurement of unfixed toner when toner is present in an unfixed state on the recording material 11 in a section from the secondary transfer nip portion N2 to the heating apparatus 40.

The control portion 108 acquires a sum density value Dsum of each point on the X-Y coordinates. The sum density value Dsum is an image density value of each point on the X-Y coordinates. The sum density value Dsum is a sum value of image density values of the four YMCK colors in each pixel block in one page of the recording material 11 and is calculated using expression (1) below.

$$Dsum(x,y)=DY(x,y)+DM(x,y)+DC(x,y)+DK(x,y) \quad (1)$$

In expression (1), DY(x, y), DM(x, y), DC(x, y), and DK(x, y) denote image density values of the respective YMCK colors at each point on the X-Y coordinates. In this manner, the control portion 108 acquires an image density value for each color of toners constituting a toner image and calculates a sum value of image density values (a sum density value Dsum) for each color of toners constituting the toner image.

The maximum sum image density value Dsum_max represents a maximum value (a maximum amount) of sum density values Dsum(x, y) of the respective pixel blocks in one page of the recording material 11. The toner coefficient E represents the number of colors constituting a pixel block indicating a maximum value out of the sum density values Dsum(x, y) of the respective pixel blocks in one page of the recording material 11. The toner coefficient E is a numerical value indicating the number of image density values that are image density values larger than 0% out of the image density values corresponding to each color of toners constituting a toner image. In addition, in the first embodiment, the video controller 109 adjusts the maximum sum image density value Dsum_max to be within a range of 0% to 300%.

Image data includes a plurality of regions (pixel blocks). The control portion 108 determines a prescribed region of which the sum density value Dsum(x, y) is a maximum value out of the plurality of regions of image data. On the basis of the sum density value Dsum(x, y) or, in other words, the maximum sum image density value Dsum_max and the toner coefficient E in the determined prescribed region, the control portion 108 determines the set temperature T using expression (2) below (S504).

$$T=200+Dsum_max\times 0.4\sqrt{E} \quad (2)$$

In this case, expression (2) is a controlling expression indicating a relationship among the maximum sum image density value Dsum_max, the toner coefficient E indicating the number of colors of toners constituting a toner image, and the set temperature T. Expression (2) is based on a relationship of a toner bearing amount on the recording material 11 with respect to the image density value of each color shown in FIGS. 7A and 7B. When the image density value of each color of toners constituting a toner image is lower than a reference value (for example, 10%), the control portion 108 does not include the number of colors of toners with respect to the image density values lower than the reference value in the toner coefficient E. In other words, when the image density value of each color of toners constituting a toner image is lower than a reference value (for example, 10%), the control portion 108 obtains the toner coefficient E by excluding the image density values lower than the reference value. Alternatively, when the image density value of each color of toners constituting a toner image is lower than a reference value (for example, 10%), the control portion 108 may include the number of colors of toners with respect to the image density values lower than the reference value in the toner coefficient E.

Figure 7A:
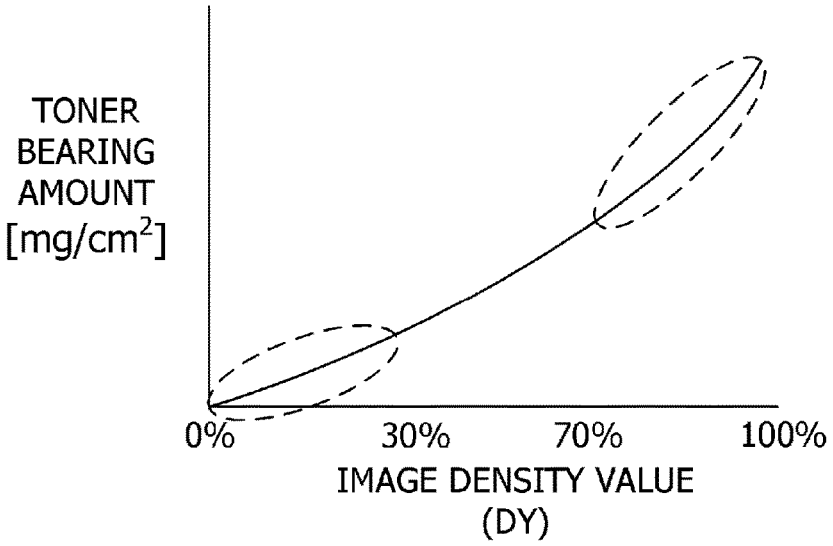
FIGS. 7A and 7B are graphs showing a relationship of a sum toner bearing amount with respect to an image density value.
Figure 7B:
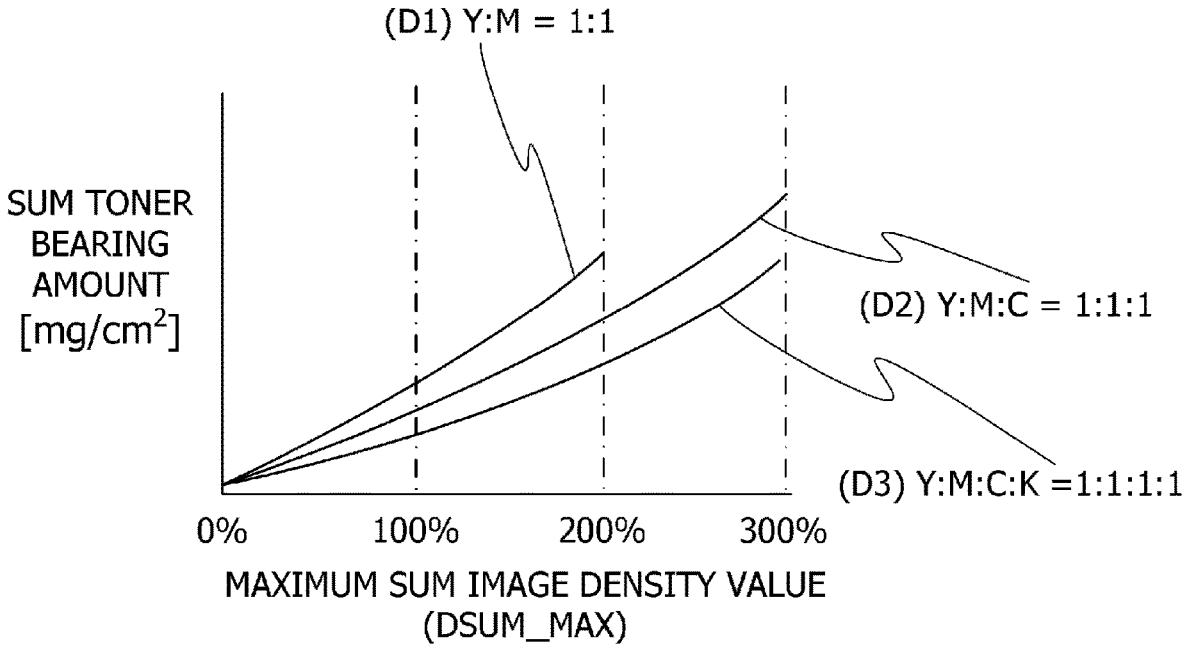

FIG. 7A is a graph showing a relationship of a toner bearing amount (a bearing amount of unfixed toner) with respect to an image density value DY in the image forming apparatus 1 according to the first embodiment. As shown in FIG. 7A, the relationship between the image density value DY and the unfixed toner amount on the recording material 11 per unit area is non-linear. Although the image density value is generally linear with respect to optical density (O.D.) or color difference (ΔE) relative to chromaticity of a reference color, the toner bearing amount on the recording material 11 may not be linear with respect to optical density and color difference and may have a non-linear relationship. As shown in FIG. 7A, in a region where the image density value is small (around 0 to 30%), an increment in the toner bearing amount with respect to the image density value is small. On the other hand, in a region where the image density value is large (around 70 to 100%), an increment in the toner bearing amount with respect to the image density value is large. Tendencies of the image density values DM, DC, and DK with respect to the toner bearing amount are similar to a tendency of the image density value DY shown in FIG. 7A. FIG. 7B is a graph showing a relationship between the maximum sum image density value Dsum_max and a sum toner bearing amount. FIG. 7B shows cases where a ratio of the respective colors of toners is (D1) Y:M=1:1, (D2) Y:M:C=1:1:1, and (D3) Y:M:C:K=1:1:1:1. As shown in FIG. 7B, when the maximum sum image density values Dsum_max of (D1) to (D3) are the same, the larger the number of colors of toners constituting a toner image, the smaller the sum toner bearing amount.

FIG. 8 is a table showing an example of temperature control parameters according to the first embodiment. FIG. 8 shows the maximum sum image density value Dsum_max, an image density value of each YMCK color, a sum toner bearing amount, the toner coefficient E, and set temperatures T and T0. FIG. 8 shows image density values of the respective YMCK colors in cases where the maximum sum image density value Dsum_max is 50%, 100%, 150%, 200%, 250%, and 300%. The set temperature T is the target temperature (control temperature) of the heating apparatus 40 calculated using expression (2) above. The set temperature T0 will be described later.

Figure 9A:
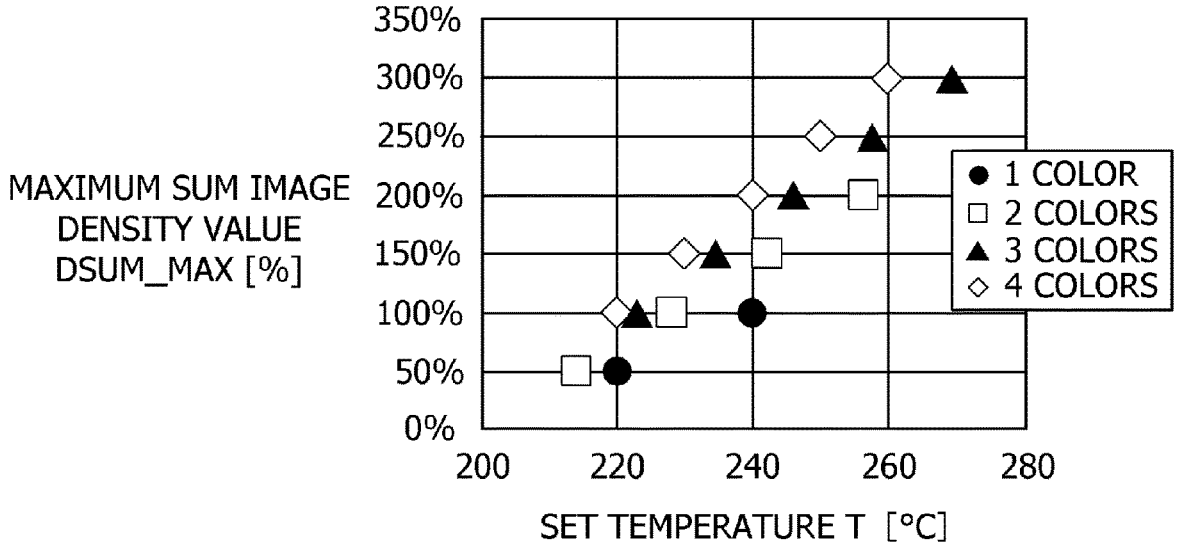
FIGS. 9A to 9D are graphs showing a relationship between an image density value and a set temperature T according to the first embodiment.

FIG. 9A is a graph showing a relationship between the maximum sum image density value Dsum_max and the set temperature T extracted from FIG. 8. As shown in FIG. 9A, while the set temperature T rises as the maximum sum image density value Dsum_max increases, when Dsum_max is the same value, the larger the number of colors of toners constituting a toner image, the lower the set temperature T. A case where the maximum sum image density value Dsum_max as a sum of image density values is 200% (A-1 to A-3 inside a bold frame A in FIG. 8) will now be described. In the case of (A-1) in FIG. 8, the toner coefficient E as the number of colors of toners constituting a toner image is "2" and the set temperature T is "257° C.". In the case of (A-2) in FIG. 8, the toner coefficient E is "3" and the set temperature T is "246° C.". In the case of (A-3) in FIG. 8, the toner coefficient E is "4" and the set temperature T is "240° C.". As shown in (A-1) to (A-3) in FIG. 8, the larger the toner coefficient E, the lower the set temperature T. When the maximum sum image density value Dsum_max is a prescribed value (for example, "200%") and the toner coefficient E is a first number (for example, "2"), the control portion 108 determines a first temperature (for example, "257° C.") as the set temperature T. When the maximum sum image density value Dsum_max is the prescribed value and the toner coefficient E is a second number (for example, "3" or "4") that is larger than the first number, the control portion 108 determines a second temperature (for example, "246° C." or "240° C.") that is lower than the first temperature as the set temperature T.

Figure 9B:
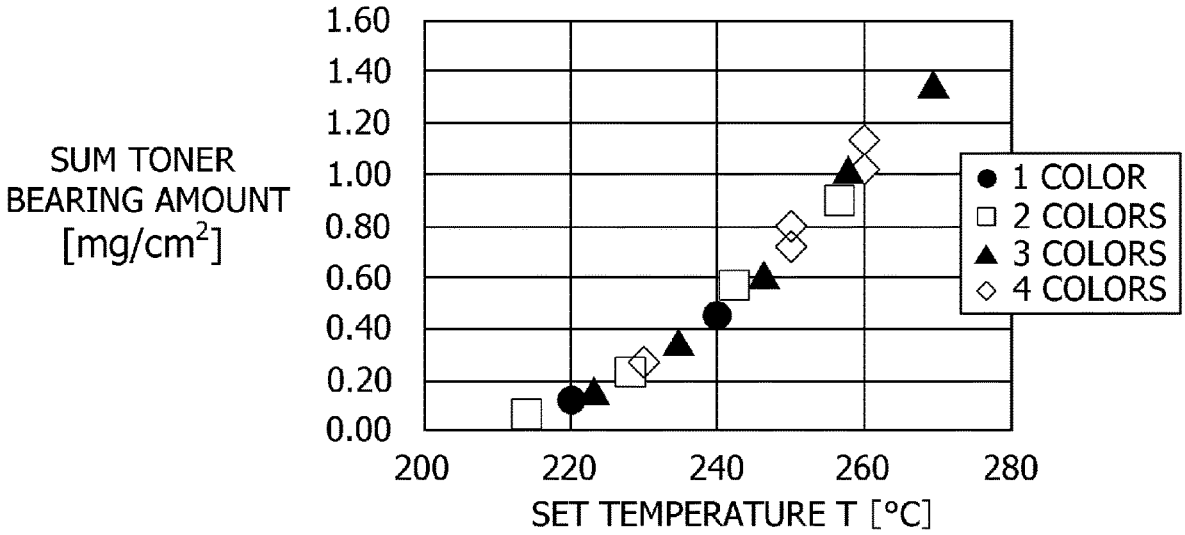

FIG. 9B is a graph showing a relationship between the sum toner bearing amount and the set temperature T extracted from FIG. 8. FIG. 9B shows that, even when the number of colors of toners (the toner coefficient E) and the maximum sum image density value Dsum_max differ, a set temperature T in accordance with the sum toner bearing amount can be adjusted. The set temperature T can be adjusted in this manner because using expression (2) above for determining the set temperature T enables the effect of both the maximum sum image density value Dsum_max and the number of colors of toners (the toner coefficient E) with respect to the set temperature T can be sufficiently taken into consideration.

Let us now return to the flow chart in FIG. 4 to continue the description of temperature control of the heating apparatus 40. The control portion 108 controls power supplied to the heating apparatus 40 so that the temperature of the heating apparatus 40 is maintained at the set temperature T. By passing the recording material 11 through the heating apparatus 40, unfixed toner is fixed to the recording material 11 (S505). The control portion 108 determines whether or not the recording material 11 is a last recording material 11 in the print job (S506). When the recording material 11 is a last recording material 11, the print operation is ended (S507). When the recording material 11 is not a last recording material 11, the job is continued, the process returns to S502, and processes of S502 to S506 are repeated until the control portion 108 determines that the recording material 11 is the last recording material 11. In the first embodiment, the temperature control of the heating apparatus 40 is performed according to the flow shown in FIG. 4.

Figure 10:
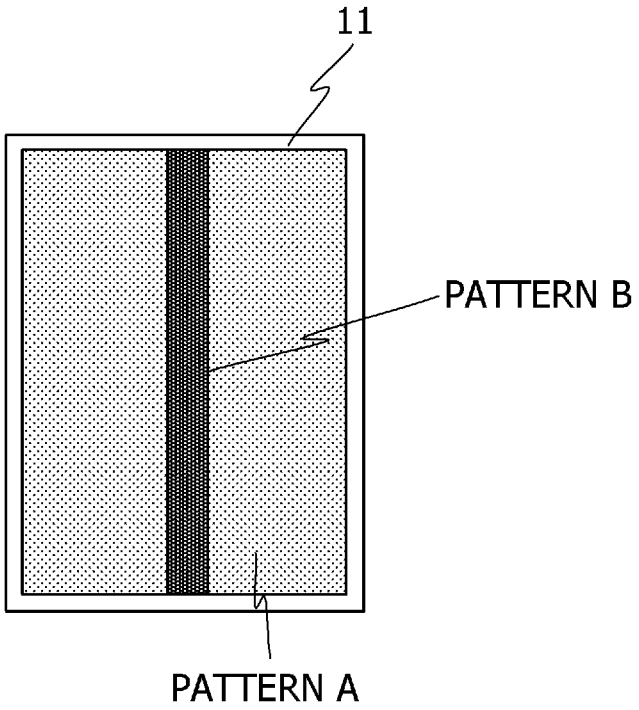
FIG. 10 is a diagram showing an image pattern when performing a comparative experiment.

The following comparative experiment was performed in order to confirm an effect of performing temperature control of the heating apparatus 40 on the basis of the image density value and the number of colors of toners according to the first embodiment. Conditions of the comparative experiment included recording material transportation speed: 300 mm/sec, print speed (throughput): 60 ppm, recording material 11: OCE Red Label paper (basis weight 80 g/m$^2$), A4 size, manufactured by Canon Inc., and the number of passed sheets: 110 sheets. FIG. 10 is a diagram showing an image pattern used when performing the comparative experiment. As shown in FIG. 10, a high-printing rate image as a pattern B is printed in addition to a low-printing rate halftone image (Bk: 5%) as a pattern A with respect to the recording material 11 used in the comparative experiment. Image creation is performed using YMCK color mode of Photoshop CS4 manufactured by Adobe Inc. The pattern B printed on the recording material 11 varies for each experimental condition. Confirmation of the effect of the comparative experiment is performed by comparing power consumption and fixability of the heating apparatus 40 with respect to 101st to 110th printed sheets. Although the comparative experiment focuses on the 101st to 110th printed sheets after the heating apparatus 40 has been sufficiently warmed up, the effect of the first embodiment is not limited to the 101st to 110th printed sheets.

FIGS. 11A to 11C are tables showing a result of the comparative experiment, and FIG. 11A shows an experimental result in a case where temperature control of the heating apparatus 40 was performed on the basis of the image density value and the number of colors of toners according to the first embodiment. In this case, a film surface temperature is a surface temperature of the fixing film 41 which comes into contact with the recording material 11 when the thermistor Th is controlled on the basis of each set temperature T in the 101st to 110th printed sheets. A thermocouple (ST-13E-010-GW1-W) manufactured by Anritsu Meter Co., Ltd. is used to measure the surface temperature of the fixing film 41. In conditions A to C in FIGS. 11A to 11C, although the maximum sum image density value Dsum_max is the same, the sum toner bearing amount differs. In the first embodiment, with respect to the conditions A to C, the set temperature T is controlled in accordance with the sum toner bearing amount and the film surface temperature also varies in accordance with the set temperature T. As a result, fixability is favorable (Good) under the conditions A to C and, at the same time, a reduction in power consumption can be achieved under the conditions B and C having a low sum toner bearing amount.

Next, a case where the temperature control according to the comparative example is performed will be described. The set temperature T0 in the temperature control according to the comparative example is obtained by expression (3) below.

$$T0=230.5+D\text{sum_max}/8 \quad (3)$$

Figure 9C:
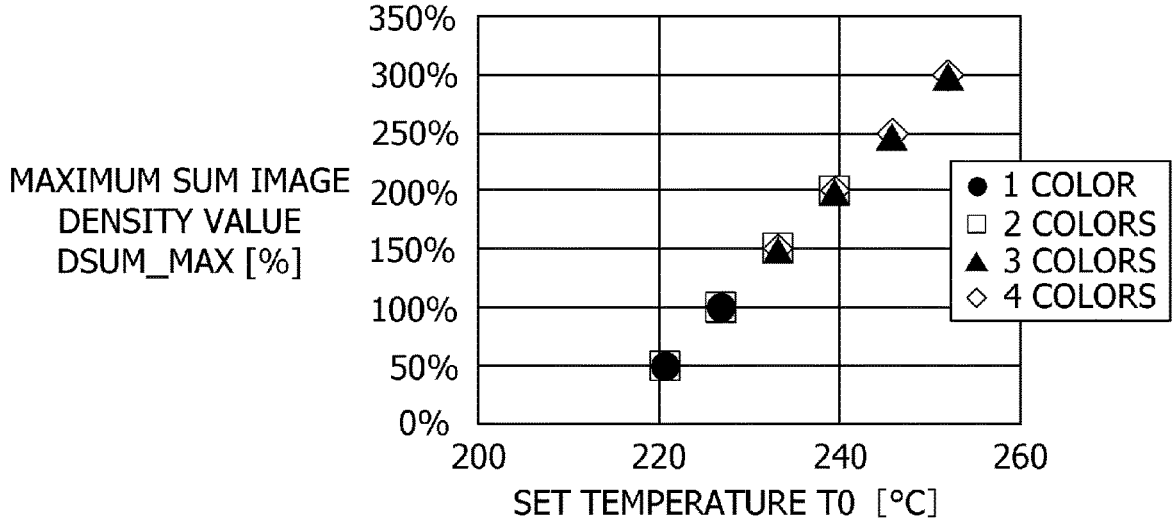
Figure 9D:
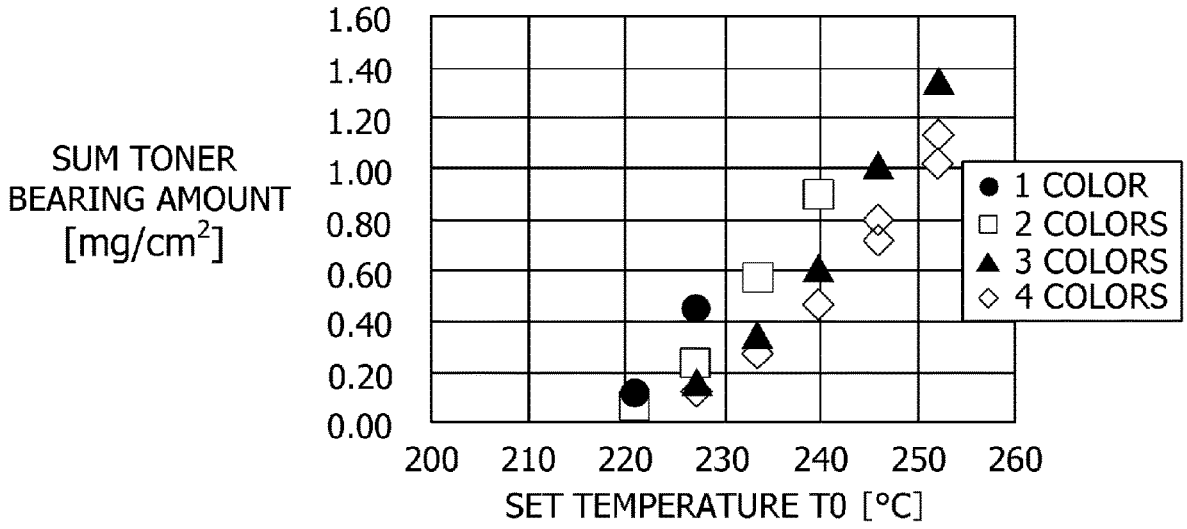

In other words, the set temperature T0 is determined solely based on the maximum sum image density value Dsum_max. FIG. 9C is a graph showing a relationship between the maximum sum image density value Dsum_max and the set temperature T0 extracted from FIG. 8. FIG. 9C shows that the set temperature T rises in accordance with the maximum sum image density value Dsum_max regardless of the number of colors of toners constituting a toner image. In addition, FIG. 9D is a graph showing a relationship between the sum toner bearing amount and the set temperature T0 extracted from FIG. 8. FIG. 9D shows that the set temperature T0 is not appropriately determined when a difference in the sum toner bearing amount is created due to a difference in the number of colors of toners.

FIG. 11B is a table showing an experimental result when performing the temperature control according to a first comparative example. In the first comparative example, temperature control is performed according to the condition A corresponding to a case where the sum toner bearing amount is high and the set temperature T0 is set to 256° C. In the first comparative example, since temperature control is performed according to the condition A corresponding to a case where the sum toner bearing amount is high, fixability is favorable (Good) under any of the conditions A to C and power consumption is more or less the same under the conditions A to C. Since temperature control is performed at the same set temperature T0 under the conditions B and C which correspond to a case where the sum toner bearing amount is low, although fixability is secured, excess power is being supplied to the heating apparatus 40.

FIG. 11C is a table showing an experimental result when performing the temperature control according to a second comparative example. In the second comparative example, temperature control is performed according to the condition C corresponding to a case where the sum toner bearing amount is low and the set temperature T0 is set to 240° C. Therefore, the set temperature T0 according to the second comparative example is lower than the set temperature T0 according to the first comparative example by 16° C. In the second comparative example, since temperature control is performed according to the condition C corresponding to a case where the sum toner bearing amount is low, although a reduction in power consumption is achieved under the conditions A to C, fixability under the conditions A and B has not been secured.

In the first embodiment, the set temperature T is determined by extracting the maximum sum image density value Dsum_max and the toner coefficient E from image data. When the maximum sum image density value Dsum_max is a same prescribed value, the larger the toner coefficient (the number of colors), the lower the set temperature T. Accordingly, the set temperature T can be appropriately determined in accordance with an actual toner bearing amount on the recording material 11. As a result, since excess heat can be prevented from being imparted to the recording material 11, power consumption can be suppressed and, at the same time, stable fixability can be secured.

In addition, in the first embodiment, when an image density value related to a prescribed color is lower than a reference value (for example, 10%), since the toner bearing amount is a minute amount, the prescribed color is not included in the toner coefficient E used to calculate the set temperature T. However, when the toner bearing amount is high despite the image density value being low, the prescribed color may be included in the toner coefficient E, and when the toner bearing amount is low despite the image density value being high, the prescribed color may not be included in the toner coefficient E. For example, the reference value may be changed as deemed appropriate in accordance with properties of the image forming apparatus 1.

In addition, while one image forming station each is arranged in the image forming apparatus 1 with respect to each toner color of four colors (YMCK) in the first embodiment, a plurality of image forming stations may be arranged in the image forming apparatus 1 for one toner color. In other words, at least two of a plurality of image forming stations may form a toner image with toners of a same color. For example, two of four image forming stations may be image forming stations of the K toner color and two of four image forming stations may be image forming stations of the M toner color. When the four image density values are all equal to or higher than the reference value, the toner coefficient E is 4. In other words, when different image forming stations having toner of a same color are arranged in the image forming apparatus 1, each of the different image forming stations having the toner of a same color is an object of calculation of the toner coefficient. The control portion 108 increases the number of the toner coefficient E in accordance with the number of the plurality of image forming stations that form the toner image with toner of a same color and, on the basis of the maximum sum image density value Dsum_max and the toner coefficient E, determines the set temperature T using expression (2) above.

First Modification

As a first modification of the first embodiment, a method of changing the set temperature T in stages according to the maximum sum image density value Dsum_max and the toner coefficient E will be described. FIG. 12A shows, in stages, a reference temperature T1 in accordance with the maximum sum image density value Dsum_max and shows that the maximum sum image density value Dsum_max is divided in a prescribed range. In addition, FIG. 12B shows, in stages, an adjusted temperature T2 in accordance with the toner coefficient E and shows that the adjusted temperature T2 rises as the toner coefficient E increases. The set temperature T according to the first modification is determined by subtracting the adjusted temperature T2 from the reference temperature T1 (T=T1−T2). FIG. 13 is a table showing an example of temperature control parameters according to the first modification. FIG. 13 shows the maximum sum image density value Dsum_max, an image density value of each YMCK color, a sum toner bearing amount, the toner coefficient E, the reference temperature T1, the adjusted temperature T2, and the set temperature T.

Figure 14A:
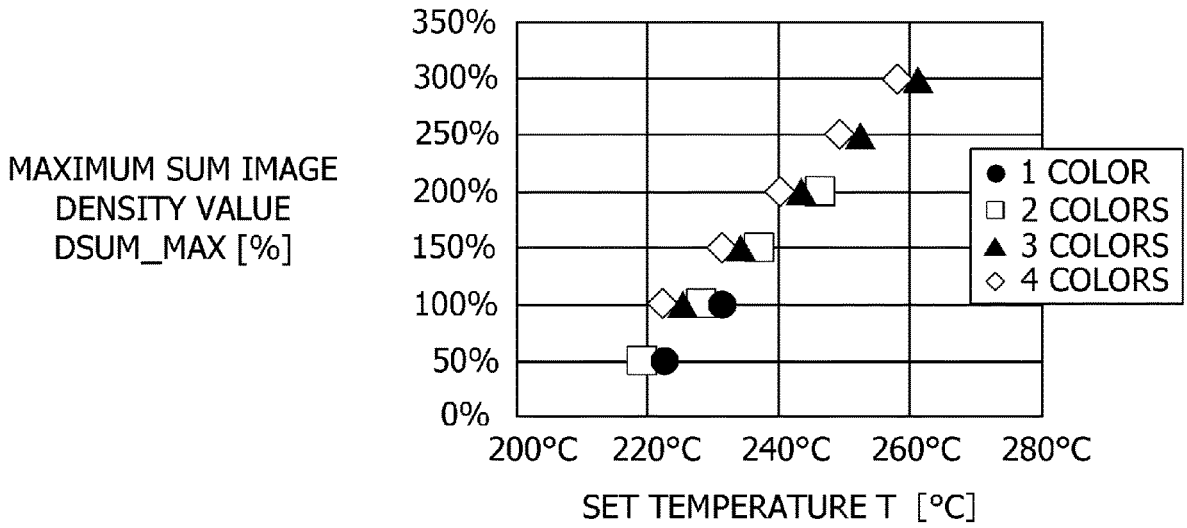
FIGS. 14A and 14B are graphs showing a relationship between an image density value and a set temperature T according to a second embodiment.
Figure 14B:
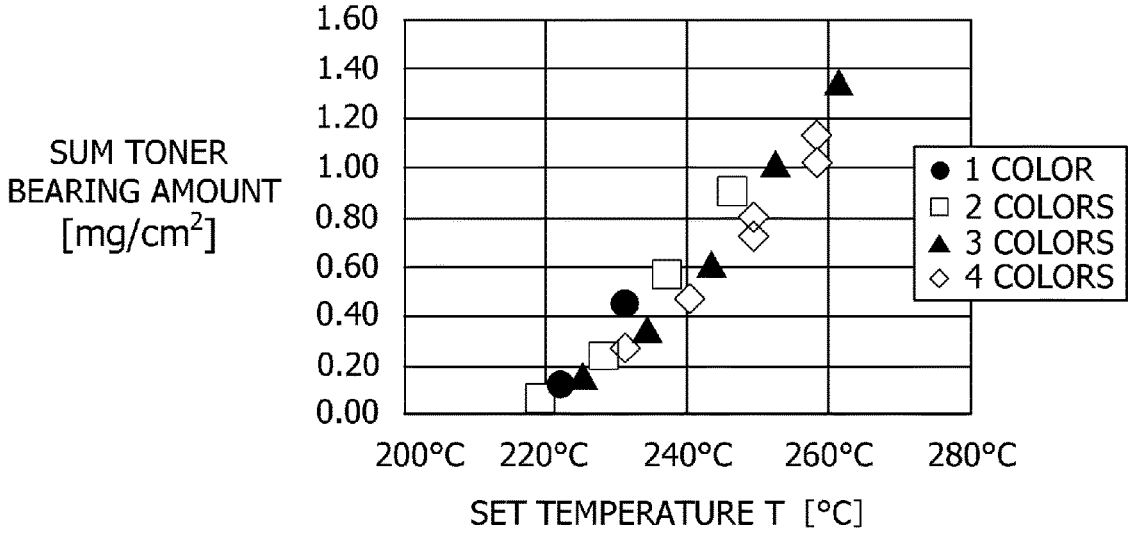

FIG. 14A is a graph showing a relationship between the maximum sum image density value Dsum_max and the set temperature T extracted from FIG. 13. As shown in FIG. 14A, the set temperature T rises in stages in accordance with the maximum sum image density value Dsum_max and the set temperature T drops in stages as the number of colors of toners constituting a toner image increases. FIG. 14B is a graph showing a relationship between the sum toner bearing amount and the set temperature T extracted from FIG. 13. FIG. 14B shows that, even when the number of colors of toners (the toner coefficient E) and the maximum sum image density value Dsum_max differ, a set temperature T in accordance with the sum toner bearing amount can be adjusted. By determining the set temperature T in stages in accordance with the maximum sum image density value Dsum_max or the toner coefficient E as in the first modification, calculation processes can be simplified. A configuration of the first embodiment or the first modification may be selected in accordance with performance of the control portion 108.

Second Embodiment

In a second embodiment, a method of deriving the set temperature T which differs from the first embodiment will be described. Otherwise, the configuration of the image forming apparatus 1 and the configuration of the heating apparatus 40 are the same and descriptions thereof will be omitted.

Description of Temperature Control of Heating Apparatus

Temperature control of the heating apparatus 40 on the basis of toner amount information according to the second embodiment will now be described with reference to the flow chart in FIG. 15. In the second embodiment, a method will be described of calculating a maximum sum toner bearing amount Wsum_max representing a largest sum toner amount of the recording material 11 from image data received by the video controller 109 and determining the set temperature T of the heating apparatus 40. Printing is started as the image forming apparatus 1 receives a print job (S601). The video controller 109 receives image data (S602). The control portion 108 calculates the maximum sum toner bearing amount Wsum_max of the recording material 11 to pass through the heating apparatus 40 next from the image data (S603). The maximum sum toner bearing amount Wsum_max will now be described. Image data of each recording material 11 is similar to contents described with reference to FIG. 5A in the first embodiment, and each pixel on X-Y coordinates at an image resolution of 600 dpi has image density. In addition, DY(x, y), DM(x, y), DC(x, y), and DK(x, y) described below are similar to the first embodiment.

Figure 16:
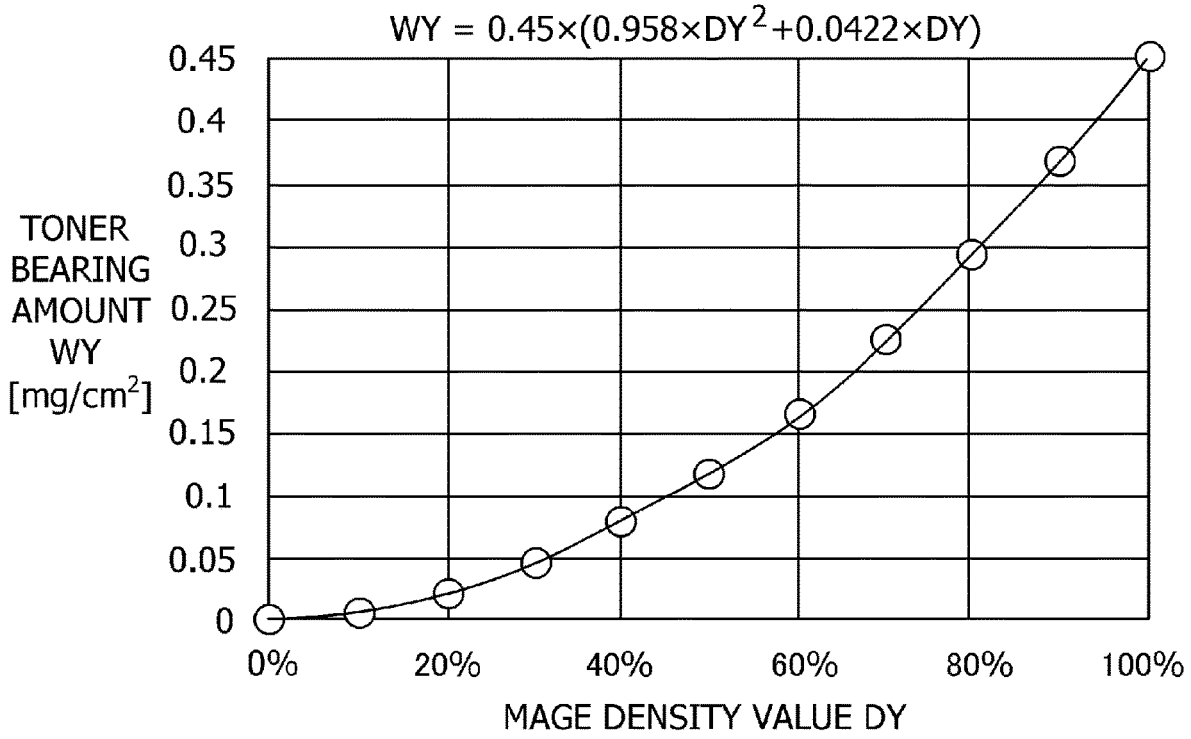
FIG. 16 is a graph showing a relationship between an image density value and a toner bearing amount according to the second embodiment.

FIG. 16 is a graph showing a relationship of a toner bearing amount WY on the recording material 11 relative to an image density value DY for the Y color acquired in advance according to the second embodiment. Based on the relationship shown in FIG. 16, the toner bearing amount WY can be calculated from the image density value DY using expression (4).

$$WY=0.45\times(0.958\times(DY)^2+0.0422\times DY) \quad (4)$$

Next, the control portion 108 acquires a sum toner bearing amount Wsum (a sum amount of toner bearing amounts) of the recording material 11 at each point on the X-Y coordinates. The sum toner bearing amount Wsum is a sum amount of toner bearing amounts of the four YMCK colors in each pixel block in one page of the recording material 11 and is calculated using expression (5) below.

$$Wsum(x,y)=WY(x,y)+WM(x,y)+WC(x,y)+WK(x,y) \quad (5)$$

In expression (5), WY(x, y), WM(x, y), WC(x, y), and WK(x, y) denote toner bearing amounts of the respective YMCK colors on the recording material 11 at each point on the X-Y coordinates. Each of WY(x, y), WM(x, y), WC(x, y), and WK(x, y) is calculated from each of DY(x, y), DM(x, y), DC(x, y), and DK(x, y) using expression (4). In a similar manner to the first embodiment, the control portion 108 acquires an image density value for each color of toners constituting a toner image. The control portion 108 calculates a toner bearing amount of each color of toners constituting a toner image from the image density value for each color of toners constituting the toner image. In this case, since a relationship of the toner bearing amounts WM, WC, and WK on the recording material 11 with respect to image density values DM, DC, and DK in the MCK colors is similar to the relationship of the toner bearing amount WY on the recording material 11 with respect to the image density value DY, the toner bearing amounts WM, WC, and WK can be calculated using expression (4) in a similar manner to the Y color.

The maximum sum toner bearing amount Wsum_max represents a maximum value (a maximum amount) of sum toner bearing amounts Wsum(x, y) of the respective pixel blocks in one page of the recording material 11. A toner image includes a plurality of regions (pixel blocks). The control portion 108 determines a prescribed region of which the sum toner bearing amount Wsum(x, y) is a maximum value out of the plurality of regions of the toner image. On the basis of the sum toner bearing amount Wsum(x, y) or, in other words, the maximum sum toner bearing amount Wsum_max in the determined prescribed region, the control portion 108 determines the set temperature T using expression (6) below (S604).

$$T=212.9-(17.994\times(Wsum_max)^2-64.066\times Wsum_max) \quad (6)$$

When the toner bearing amount of each color of toners constituting a toner image is lower than a reference value, the control portion 108 does not include the toner bearing amount that is lower than the reference value in the maximum sum toner bearing amount Wsum_max. Alternatively, when the toner bearing amount of each color of toners constituting a toner image is lower than a reference value, the control portion 108 may include the toner bearing amount that is lower than the reference value in the maximum sum toner bearing amount Wsum_max.

Figure 18A:
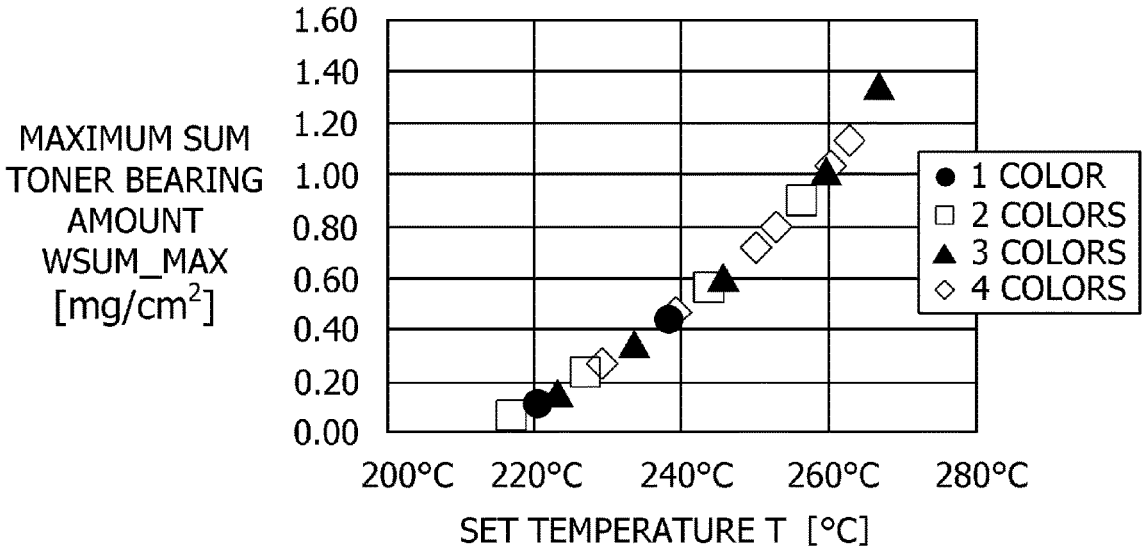
FIGS. 18A and 18B are graphs showing a relationship between a maximum toner bearing amount and a set temperature T according to the second embodiment.

FIG. 17 is a table showing an example of temperature control parameters according to the second embodiment. FIG. 17 shows the maximum sum image density value Dsum_max, an image density value of each YMCK color, the maximum sum toner bearing amount Wsum_max, the toner coefficient E, and the set temperature T. FIG. 18A is a graph showing a relationship between the maximum sum toner bearing amount Wsum_max and the set temperature T extracted from FIG. 17. FIG. 18A shows that, even when the number of colors of toners (the toner coefficient E) and the image density value of each YMCK color differ, since the set temperature T is determined on the basis of the maximum sum toner bearing amount Wsum_max, the set temperature T in accordance with an unfixed toner amount on the recording material 11 can be adjusted.

Figure 18B:
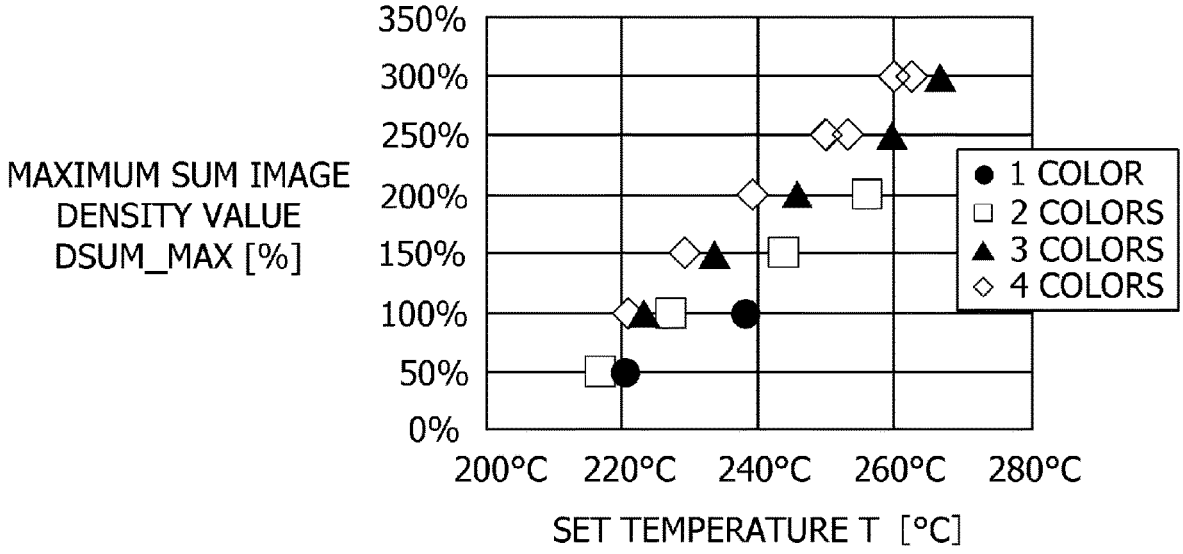

In addition, FIG. 18B is a graph showing, as a reference, a relationship among the set temperature T obtained in the second embodiment, the maximum sum image density value Dsum_max, and the toner coefficient E (the number of colors). As shown in FIG. 18B, while the set temperature T rises as the maximum sum image density value Dsum_max increases, when Dsum_max is the same value, the larger the number of colors (the toner coefficient E) of toners constituting a toner image, the lower the set temperature T. A case where the maximum sum image density value Dsum_max as a sum of image density values is 200% (B-1 to B-3 inside a bold frame B in FIG. 17) will now be described. In the case of (B-1) in FIG. 17, the toner coefficient E as the number of colors of toners constituting a toner image is "2" and the set temperature T is "256° C.". In the case of (B-2) in FIG. 17, the toner coefficient E is "3" and the set temperature T is "245° C.". In the case of (B-3) in FIG. 17, the toner coefficient E is "4" and the set temperature T is "239° C.". As shown in (B-1) to (B-3) in FIG. 17, the larger the toner coefficient E, the lower the set temperature T. When the maximum sum image density value Dsum_max is a prescribed value (for example, "200%") and the toner coefficient E is a first number (for example, "2"), a first temperature (for example, "256° C.") is determined as the set temperature T. When the maximum sum image density value Dsum_max is the prescribed value and the toner coefficient E is a second number (for example, "3" or "4") that is larger than the first number, a second temperature (for example, "245° C." or "239° C.") that is lower than the first temperature is determined as the set temperature T.

Figure 15:
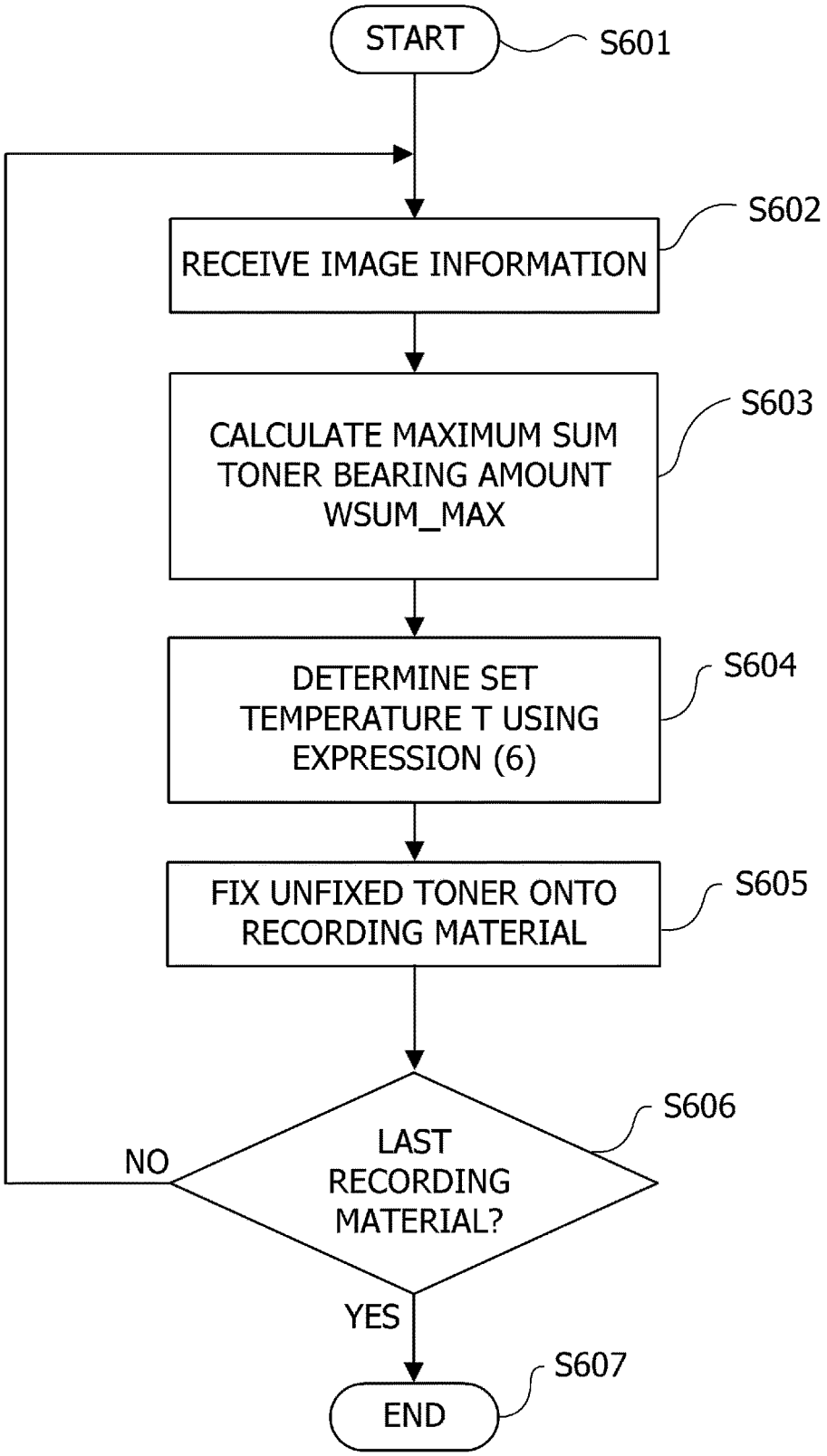
FIG. 15 is a flow chart showing a temperature control method of a heating apparatus according to the second embodiment.

Let us now return to the flow chart in FIG. 15 to continue the description of temperature control of the heating apparatus 40. The control portion 108 controls power supplied to the heating apparatus 40 so that the temperature of the heating apparatus 40 is maintained at the set temperature T. By passing the recording material 11 through the heating apparatus 40, unfixed toner is fixed to the recording material 11 (S605). The control portion 108 determines whether or not the recording material 11 is a last recording material 11 in the print job (S606). When the recording material 11 is a last recording material 11, the print operation is ended (S607). When the recording material 11 is not a last recording material 11, the job is continued, the process returns to S602, and processes of S602 to S606 are repeated until the last recording material 11 is processed. In the second embodiment, the temperature control of the heating apparatus 40 is performed according to the flow shown in FIG. 15.

In addition, while one image forming station each is arranged in the image forming apparatus 1 with respect to each toner color of four colors (YMCK) in the second embodiment, a plurality of image forming stations may be arranged in the image forming apparatus 1 for one toner color. In other words, at least two of a plurality of image forming stations may form a toner image of a same color. When calculating the sum toner bearing amount Wsum using expression (5) above, the control portion 108 calculates the sum toner bearing amount Wsum by multiplying a toner bearing amount of a same color by the number of the plurality of image forming stations that form a toner image using toner of the same color.

FIG. 19 is a table showing a result of a comparative experiment performed by a similar method to the first embodiment. Results of comparative examples 1 and 2 as comparison objects are similar to FIGS. 11B and 11C. In conditions A to C in FIG. 19, although the maximum sum image density value Dsum_max is the same, the sum toner bearing amount differs. In the second embodiment, the set temperature T is determined in accordance with the sum toner bearing amount and the film surface temperature also varies in accordance with the set temperature T. As a result, fixability is favorable (Good) and, at the same time, a reduction in power consumption can be achieved under the conditions B and C having a low sum toner bearing amount.

In the second embodiment, a toner bearing amount in each pixel block of image data on the recording material 11 is calculated and the set temperature T is determined in accordance with a maximum sum toner bearing amount thereof. On the other hand, in the first embodiment, the set temperature T is determined with respect to each pixel block of image data from a relationship between a maximum sum image density value and a toner coefficient (the number of colors). The first embodiment has an advantage in that the absence of a calculation process of a toner bearing amount enables processing by the CPU to be simplified while the second embodiment enables the set temperature T to be determined in accordance with a toner bearing amount. Therefore, the second embodiment has an advantage in that the set temperature T can be adjusted more accurately in accordance with a pixel block with a high toner bearing amount. Whichever is suitable between the first and second embodiments may be selected in consideration of a calculation load on the CPU and fixing performance that is required of the heating apparatus 40.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-242510, filed on Dec. 26, 2018, which is hereby incorporated by reference herein in its entirety.

What is claimed is:

1. An image forming apparatus, comprising:

a fixing portion configured to fix a toner image formed in accordance with image data to a recording material;

a determining portion configured to acquire a density value indicating image density represented by the image data for each of colors of toners constituting the toner image, obtain a sum value of the density values with respect to the colors of the toners, obtain a numerical value indicating the number of the density values being values larger than 0 out of the density values corresponding to the colors of the toners, and determine a target temperature for maintaining a temperature of the fixing portion on the basis of the sum value and the numerical value; and a control portion configured to control power to be supplied to the fixing portion so that the temperature of the fixing portion is maintained at the target temperature, wherein in a case the sum value is a first value and the numerical value is a first number, the determining portion determines a first temperature as the target temperature, in a case the sum value is the first value and the numerical value is a second number that is larger than the first number, the determining portion determines a second temperature that is lower than the first temperature as the target temperature.

2. The image forming apparatus according to claim 1, wherein when the density value with respect to the each of the colors of the toners is lower than a reference value, the determining portion obtains the numerical value by excluding the density value that is lower than the reference value.

3. The image forming apparatus according to claim 1, further comprising:

a plurality of image forming stations for forming the toner image, wherein at least two of the plurality of image forming stations form the toner image using the toners of a same color, and the determining portion determines the target temperature by increasing the numerical value in accordance with the number of the plurality of image forming stations that form the toner image using the toners of the same color.

4. The image forming apparatus according to claim 1, wherein the image data includes a plurality of regions, and the determining portion determines a prescribed region of which the sum value is a maximum value out of the plurality of regions, and determines the target temperature on the basis of the sum value and the numerical value in the prescribed region.

5. An image forming apparatus, comprising:

a fixing portion configured to fix a toner image formed in accordance with image data to a recording material;

a determining portion configured to acquire a density value indicating image density represented by the image data for each of colors of toners constituting the toner image, calculate a toner bearing amount for the each of the colors of the toners from the density values with respect to the respective colors of the toners, obtain a sum amount of the toner bearing amounts with respect to the respective colors of the toners, and determine a target temperature for maintaining a temperature of the fixing portion on the basis of the sum amount; and a control portion configured to control power to be supplied to the fixing portion so that the temperature of the fixing portion is maintained at the target temperature.

6. The image forming apparatus according to claim 5, wherein when the toner bearing amount of at least one of the respective colors of the toners is lower than a reference amount, the determining portion does not include the toner bearing amount that is lower than the reference amount in the sum amount.

7. The image forming apparatus according to claim 5, further comprising:

a plurality of image forming stations for forming the toner image, wherein at least two of the plurality of image forming stations form the toner image using the toners of a same color, and the determining portion calculates the sum amount by multiplying the toner bearing amount of the same color by the number of the plurality of image forming stations that form the toner image using the toners of the same color.

8. The image forming apparatus according to claim 5, wherein the toner image includes a plurality of regions, and the determining portion determines a prescribed region of which the sum amount is a maximum amount from the plurality of regions, and determines the target temperature on the basis of the sum amount in the prescribed region.

9. An image forming method, causing a computer included in an image forming apparatus to perform:

a fixing step of fixing a toner image formed in accordance with image data to a recording material using a fixing portion;

a determining step of acquiring a density value indicating image density represented by the image data for respective colors of toners constituting the toner image, obtaining a sum value of the density values with respect to the respective colors of the toners, obtaining a numerical value indicating the number of the density values being values larger than 0 out of the density values corresponding to the respective colors of the toners, and determining a target temperature for maintaining a temperature of the fixing portion on the basis of the sum value and the numerical value; and a controlling step of controlling power to be supplied to the fixing portion so that the temperature of the fixing portion is maintained at the target temperature, wherein the determining step includes, in a case the sum value is a first value and the numerical value is a first number, determining a first temperature as the target temperature, in a case the sum value is the first value and the numerical value is a second number that is larger than the first number, determining a second temperature that is lower than the first temperature as the target temperature.

10. The image forming method according to claim 9, wherein determining step includes, when the density value with respect to the each of the colors of the toners is lower than a reference value, obtaining the numerical value by excluding the density value that is lower than the reference value.

11. The image forming method according to claim 9, wherein the image forming apparatus includes a plurality of image forming stations for forming the toner image, at least two of the plurality of image forming stations form the toner image using the toners of a same color, and the determining step includes determining the target temperature by increasing the numerical value in accordance with the number of the plurality of image forming stations that form the toner image using the toners of the same color.

12. The image method apparatus according to claim 9, wherein the image data includes a plurality of regions, and the determining step includes determining a prescribed region of which the sum value is a maximum value out of the plurality of regions, and determining the target temperature on the basis of the sum value and the numerical value in the prescribed region.

13. An image forming method, causing a computer included in an image forming apparatus to perform:

a fixing step of fixing a toner image formed in accordance with image data to a recording material using a fixing portion;

a determining step of acquiring a density value indicating image density represented by the image data for respective colors of toners constituting the toner image, calculating a toner bearing amount for the respective colors of the toners from the density value with respect to the respective colors of the toners, obtaining a sum amount of the toner bearing amounts with respect to the respective colors of the toners, and determining a target temperature for maintaining a temperature of the fixing portion on the basis of the sum amount; and a controlling step of controlling power to be supplied to the fixing portion so that the temperature of the fixing portion is maintained at the target temperature.

14. The image forming method according to claim 13, wherein in the determining step, when the toner bearing amount of at least one of the respective colors of the toners is lower than a reference amount, the toner bearing amount that is lower than the reference amount is not included in the sum amount.

15. The image forming method according to claim 13, wherein the image forming apparatus includes a plurality of image forming stations for forming the toner image, at least two of the plurality of image forming stations form the toner image using the toners of a same color, and the determining step includes calculating the sum amount by multiplying the toner bearing amount of the same color by the number of the plurality of image forming stations that form the toner image using the toners of the same color.

16. The image forming method according to claim 13, wherein the toner image includes a plurality of regions, and the determining step includes determining a prescribed region of which the sum amount is a maximum amount from the plurality of regions, and determining the target temperature on the basis of the sum amount in the prescribed region.

* * * * *